US011421853B2

(12) United States Patent
Shih et al.

(10) Patent No.: US 11,421,853 B2
(45) **Date of Patent: *Aug. 23, 2022**

(54) LIGHT DISTRIBUTION MODULE

(71) Applicant: LEOTEK CORPORATION, Taipei (TW)

(72) Inventors: Wei-Wen Shih, Taipei (TW); Shih-Chang Wang, Taipei (TW)

(73) Assignee: LEOTEK CORPORATION, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/399,061

(22) Filed: Aug. 11, 2021

(65) Prior Publication Data

US 2021/0372589 A1 Dec. 2, 2021

Related U.S. Application Data

(63) Continuation of application No. 16/190,178, filed on Nov. 14, 2018, now Pat. No. 11,125,414.

(Continued)

(30) Foreign Application Priority Data

Sep. 12, 2018 (CN) ..... 201811061681.7

(51) Int. Cl.
*F21V 5/04* (2006.01)
*F21S 8/08* (2006.01)

(Continued)

(52) U.S. Cl.
CPC ..... *F21V 5/045* (2013.01); *F21S 8/086* (2013.01); *F21V 5/08* (2013.01); *F21V 13/04* (2013.01);

(Continued)

(58) Field of Classification Search
CPC . F21V 5/045; F21V 5/08; F21V 13/04; F21V 5/008; F24S 8/086
See application file for complete search history.

(56) References Cited

U.S. PATENT DOCUMENTS 2,253,409 A * 8/1941 Yost ..... F21V 14/02 362/268
5,632,551 A * 5/1997 Roney ..... F21K 9/00 362/267

(Continued)

FOREIGN PATENT DOCUMENTS

CN 204141300 2/2015
TW M461760 9/2013

(Continued)

OTHER PUBLICATIONS

"Office Action of Taiwan Counterpart Application", dated Aug. 26, 2021, p. 1-p. 7.

*Primary Examiner* — Bryon T Gyllstrom
*Assistant Examiner* — Christopher E Dunay
(74) *Attorney, Agent, or Firm* — JCIPRNET

(57) ABSTRACT

A light distribution module configured to control a light distribution of a light source is provided. The light distribution module includes a lens and an optical cover. The lens has a first light-incident surface, a first light-emitting surface opposite to the first light-incident surface, and an accommodating recess located at a side of the first light-incident surface, wherein the accommodating recess is configured to contain the light source. The optical cover covers the lens and has a second light-incident surface and a second light-emitting surface opposite to the second light-incident surface, wherein the second light-incident surface is located between the first light-emitting surface and the second light-emitting surface, and the second light-incident surface has a plurality of sub-curved surfaces. Boundaries between adjacent sub-curved surfaces are bent-shaped with respect to the adjacent sub-curved surfaces.

15 Claims, 32 Drawing Sheets

Related U.S. Application Data

(60) Provisional application No. 62/586,178, filed on Nov. 15, 2017.

(51) Int. Cl.

| | |
|---|---|
| ***F21V 13/04*** | (2006.01) |
| ***F21V 5/08*** | (2006.01) |
| *F21V 3/02* | (2006.01) |
| *F21Y 115/10* | (2016.01) |
| *F21W 111/02* | (2006.01) |
| *F21W 131/103* | (2006.01) |

(52) U.S. Cl.
CPC ..... *F21V 3/02* (2013.01); *F21W 2111/02* (2013.01); *F21W 2131/103* (2013.01); *F21Y 2115/10* (2016.08)

(56) References Cited

U.S. PATENT DOCUMENTS

| | | | | |
|---|---|---|---|---|
| 6,019,493 | A * | 2/2000 | Kuo | F21V 5/04 362/267 |
| 8,010,319 | B2 * | 8/2011 | Walters | H04L 67/18 700/83 |
| 9,170,001 | B2 * | 10/2015 | Schenkl | F21V 5/02 |
| 9,683,717 | B1 * | 6/2017 | Householder | F21V 5/008 |
| 2004/0095768 | A1 * | 5/2004 | Watanabe | F21V 5/00 362/244 |
| 2015/0159842 | A1 | 6/2015 | Zhang | |
| 2017/0241622 | A1 * | 8/2017 | Du | F21V 14/003 |

FOREIGN PATENT DOCUMENTS

| | | |
|---|---|---|
| TW | 201441663 | 11/2014 |
| TW | 201619541 | 6/2016 |
| TW | 201621221 | 6/2016 |

* cited by examiner

130C

130C

LIGHT DISTRIBUTION MODULE

CROSS-REFERENCE TO RELATED APPLICATION

This application is a continuation application of and claims the priority benefit of U.S. application Ser. No. 16/190,178, filed on Nov. 14, 2018, now allowed, which claims the priority benefits of U.S. provisional application Ser. No. 62/586,178, filed on Nov. 15, 2017, and China application serial no. 201811061681.7, filed on Sep. 12, 2018. The entirety of each of the above-mentioned patent applications is hereby incorporated by reference herein and made a part of this specification.

BACKGROUND OF THE INVENTION

Field of the Invention

The invention relates to an optical module, and more particularly, to a light distribution module.

Description of Related Art

In the traditional lighting device design, the light source is disposed on an optical cover to produce the required light shape. For road lighting device, in order to meet the regulations and lighting requirements in different regions/countries, a lighting device often requires several kinds or even dozen kinds of optical covers.

However, road lighting devices often require a long development period and are costly. Furthermore, the need for each additional optical cover also means an additional maintenance cost. Therefore, for the manufacturers of road lighting devices, there is a need for a lighting device that require fewer number of optical covers to meet the regulations and requirements in different regions/countries.

SUMMARY OF THE INVENTION

The invention provides a light distribution module that may require fewer number of developments thereof.

An embodiment of the invention provides a light distribution module configured to control a light distribution from a light source. The light distribution module includes a lens and an optical cover. The lens has a first light-incident surface, a first light-emitting surface opposite to the first light-incident surface, and an accommodating recess located at a side of the first light-incident surface, wherein the accommodating recess is configured to contain the light source. The optical cover covers the lens and has a second light-incident surface and a second light-emitting surface opposite to the second light-incident surface, wherein the second light-incident surface is located between the first light-emitting surface and the second light-emitting surface, and the second light-incident surface has a plurality of sub-curved surfaces. Boundaries between adjacent sub-curved surfaces are bent-shaped with respect to the adjacent sub-curved surfaces. One of the lens and the optical cover produces a first light shape that is rotationally symmetric or non-rotationally symmetric, and the other of the lens and the optical cover produces a second light shape that is rotationally symmetric.

Based on the above, the light distribution module in an embodiment of the invention includes a lens and an optical cover, and one of the lens and the optical cover produces a first light shape that is rotationally symmetric or non-rotationally symmetric, and the other of the lens and the optical cover produces a second light shape that is rotationally symmetric. Therefore, the light distribution module according to the embodiment of the invention may produce a desired light shape through a combination of the lens and the optical cover, thereby greatly reducing the number of designs of the optical cover.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
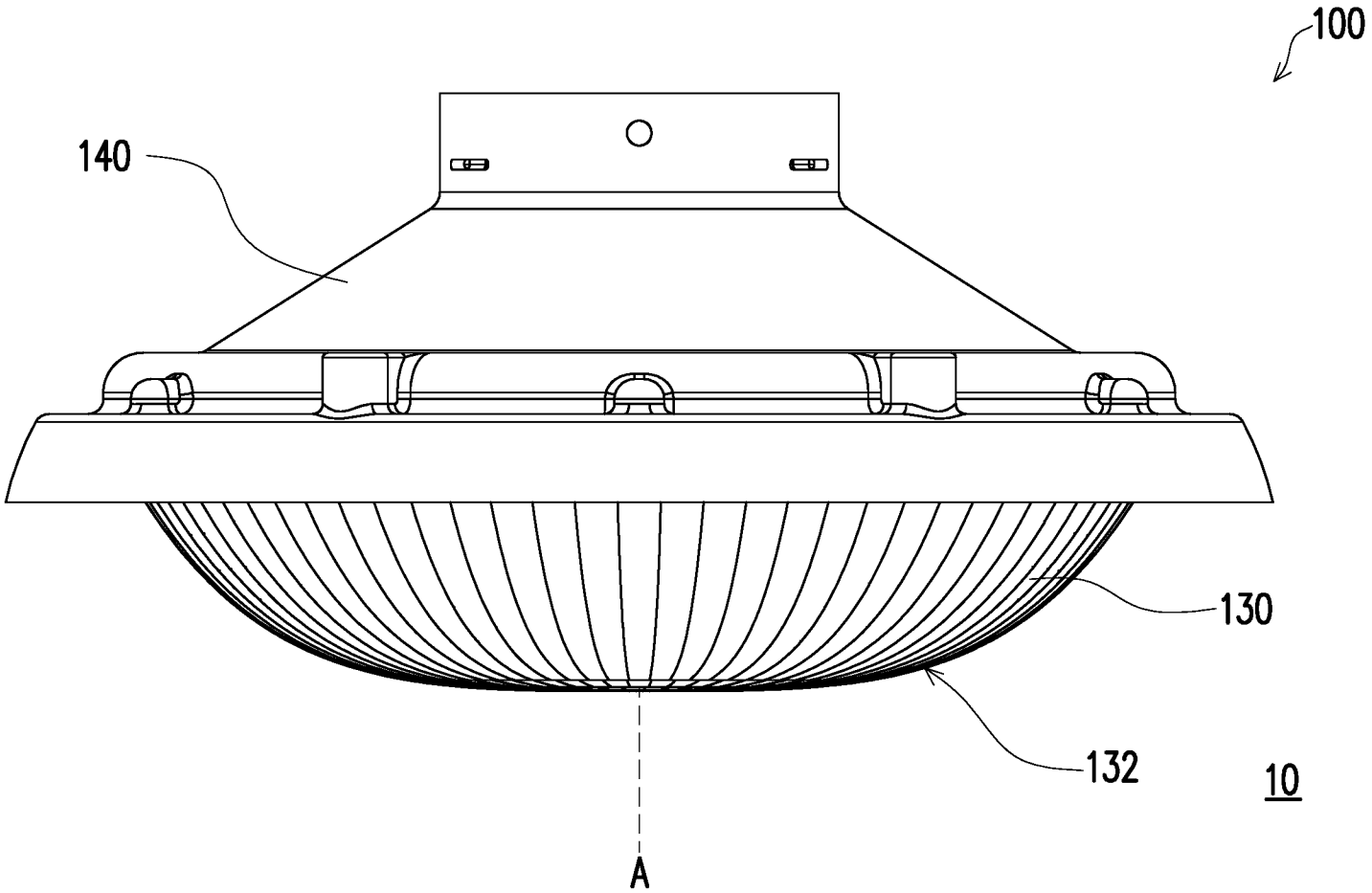
FIG. 1A shows a side view of a lighting device of the first embodiment of the invention.
Figure 1B:
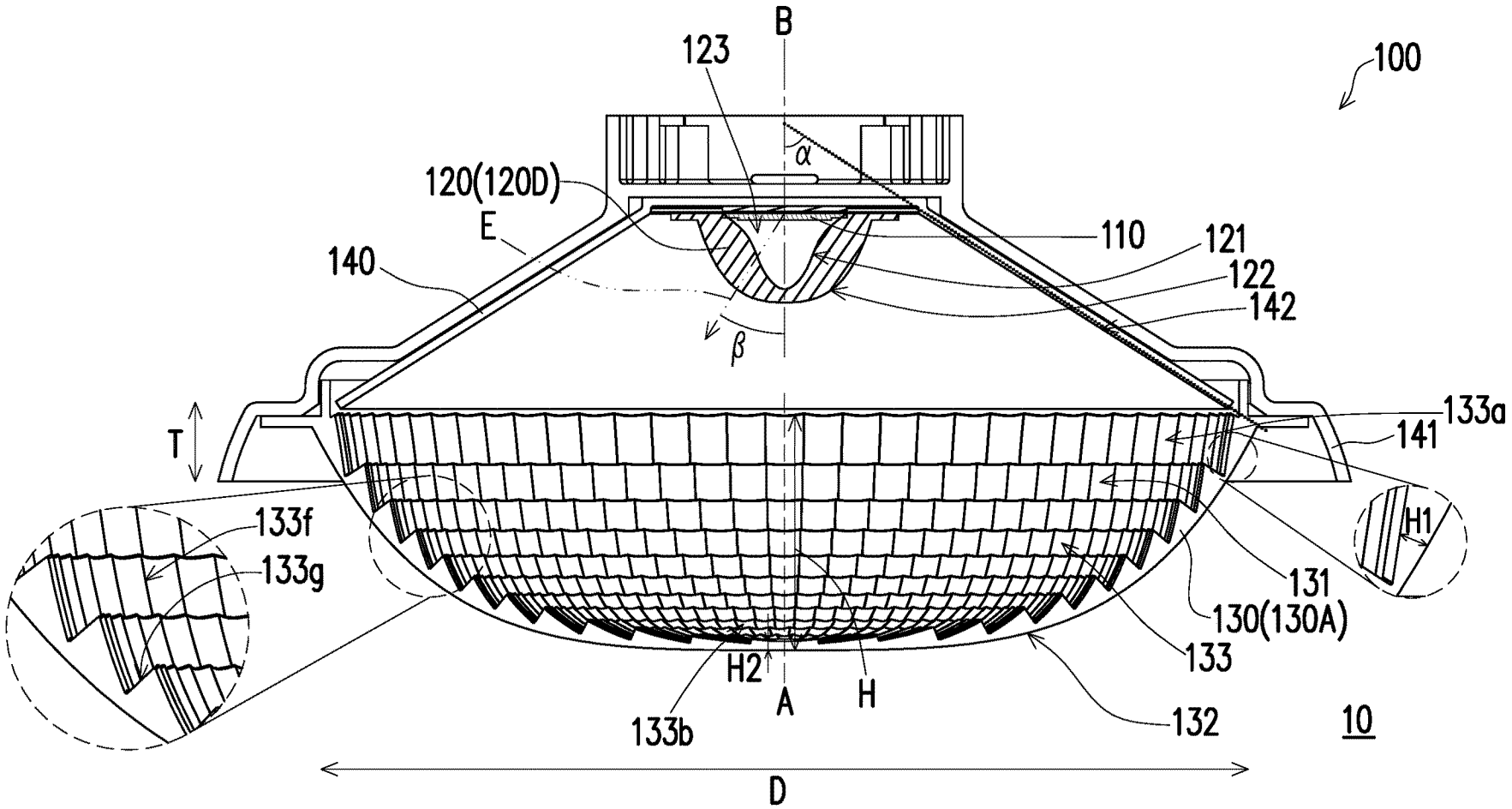
FIG. 1B is a cross-section of the lighting device of FIG. 1A cut along an optical axis A.
Figure 2C:
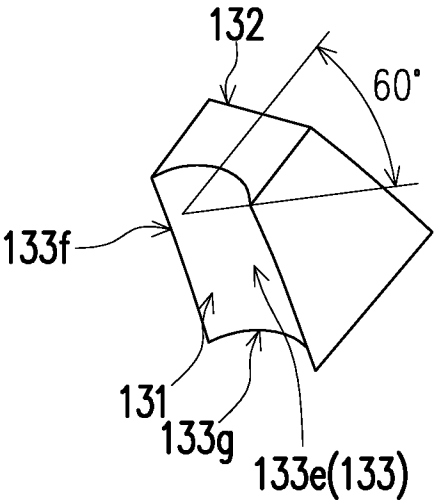
FIGS. 2A to 2C are schematics of three kinds of sub-curved surfaces of an optical cover in an embodiment of the invention.
Figure 2B:
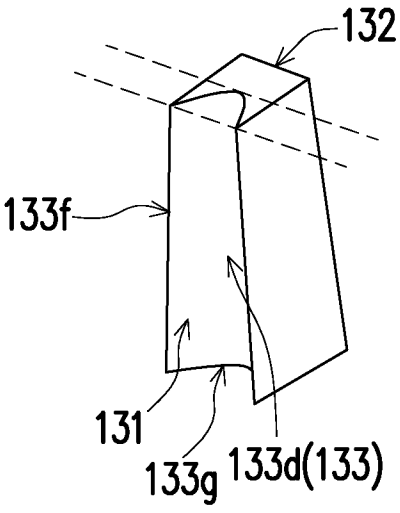
Figure 2A:
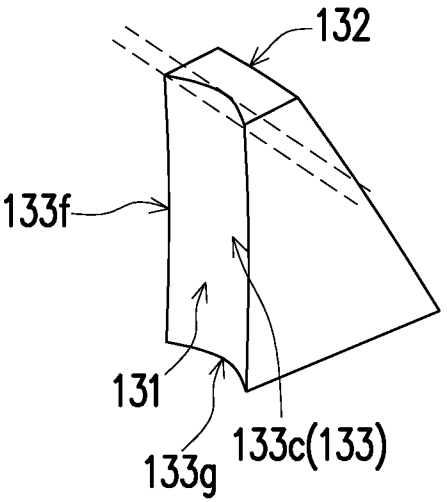
Figure 3B:
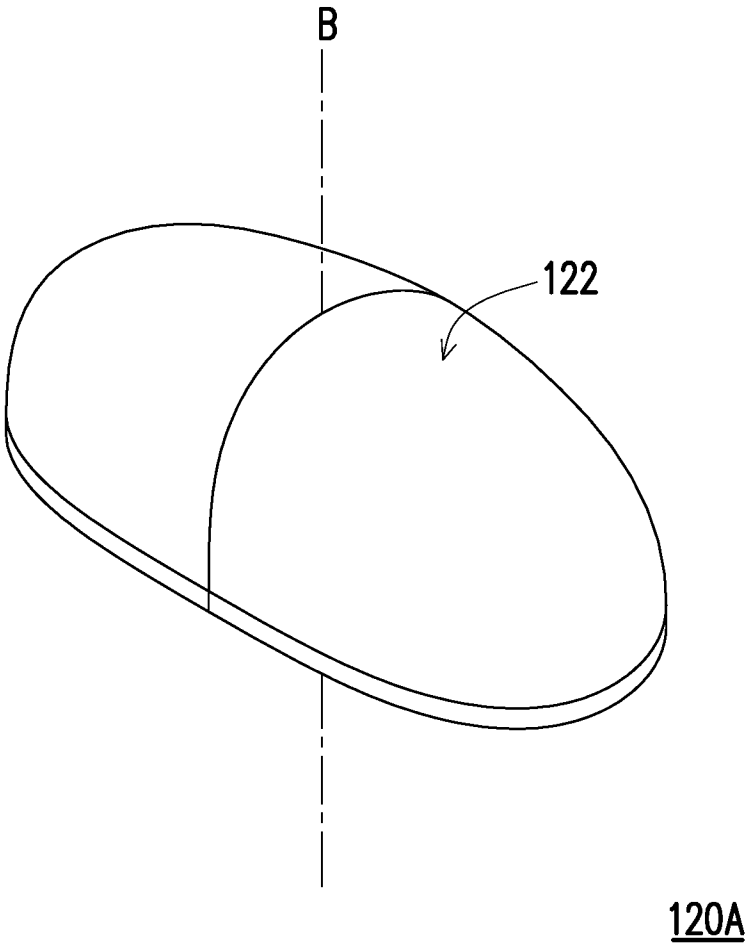
FIGS. 3A to 3B are perspective views of a lens of an embodiment of the invention.
Figure 3A:
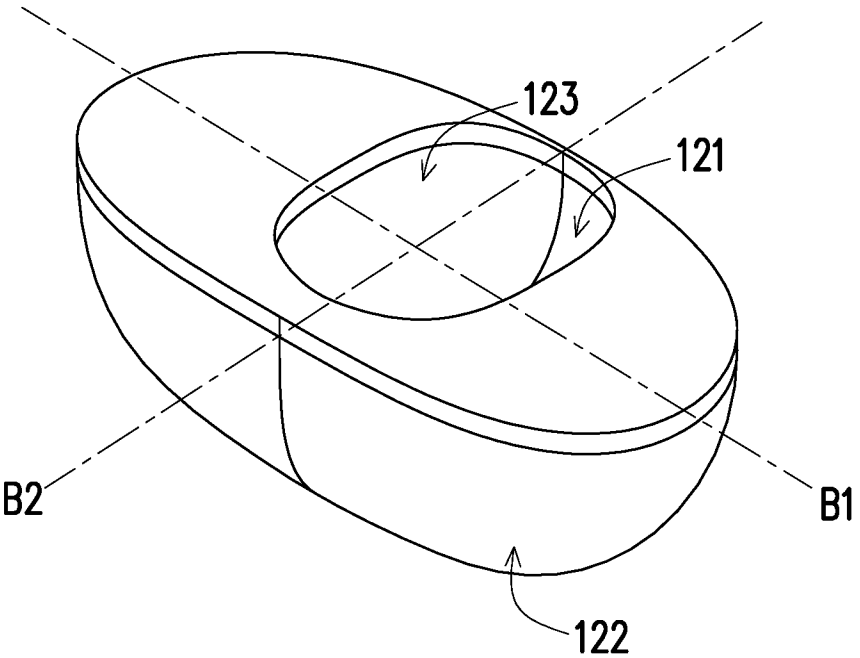
Figure 3D:
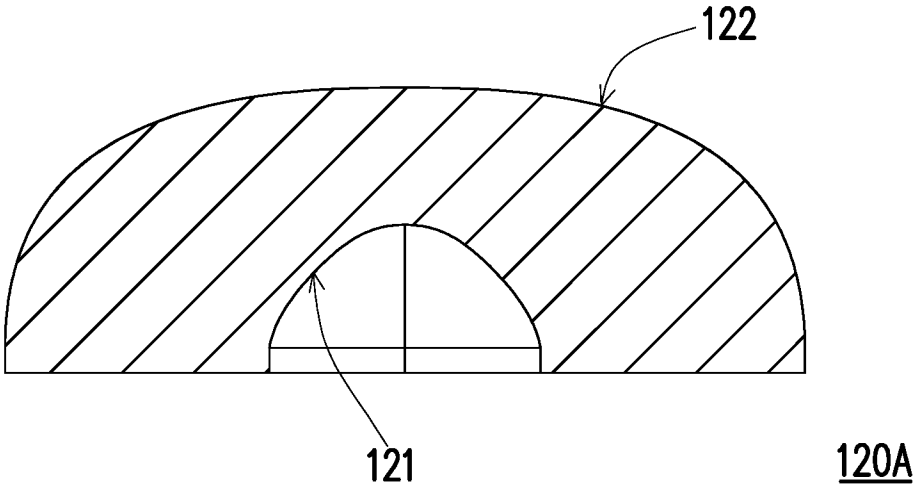
FIG. 3C and FIG. 3D are respectively cross-sections of the lens of FIG. 3B along a second long axis B2 and a first long axis B1.
Figure 3C:
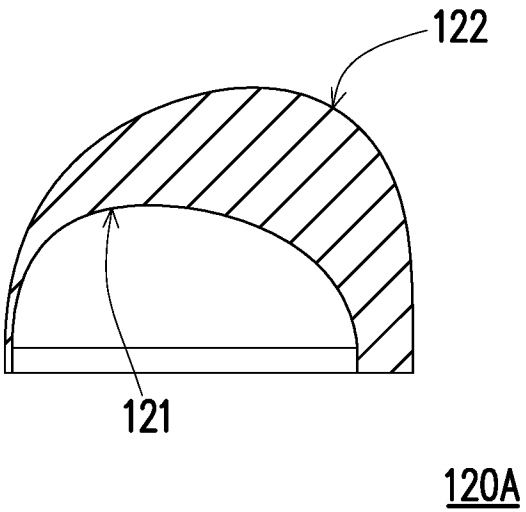
Figure 4B:
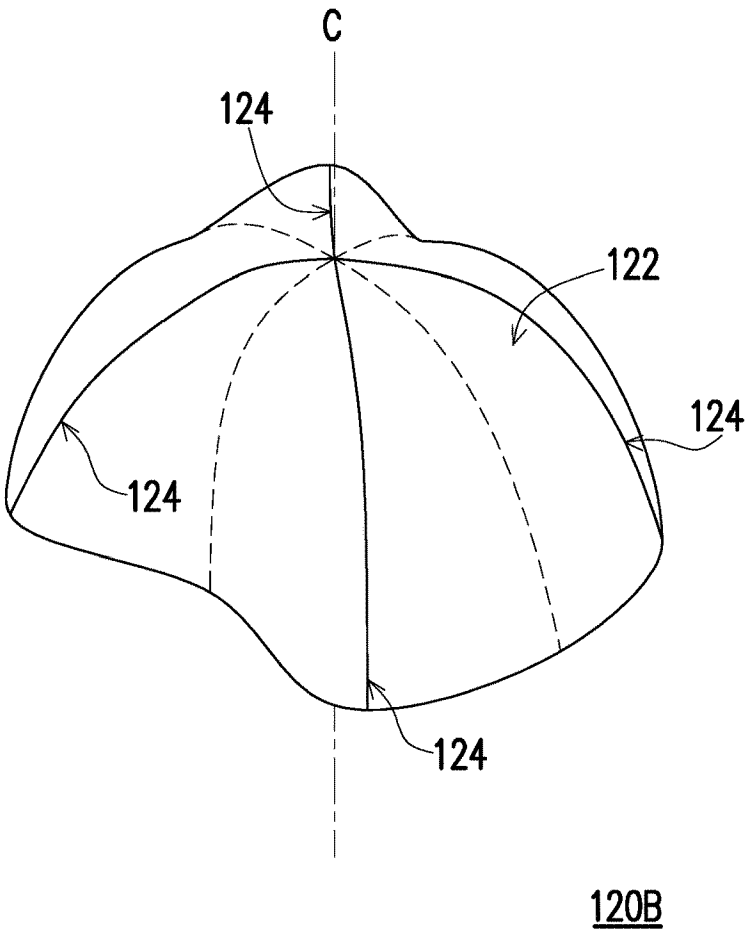
FIGS. 4A to 4B are perspective views of a lens of another embodiment of the invention.
Figure 4A:
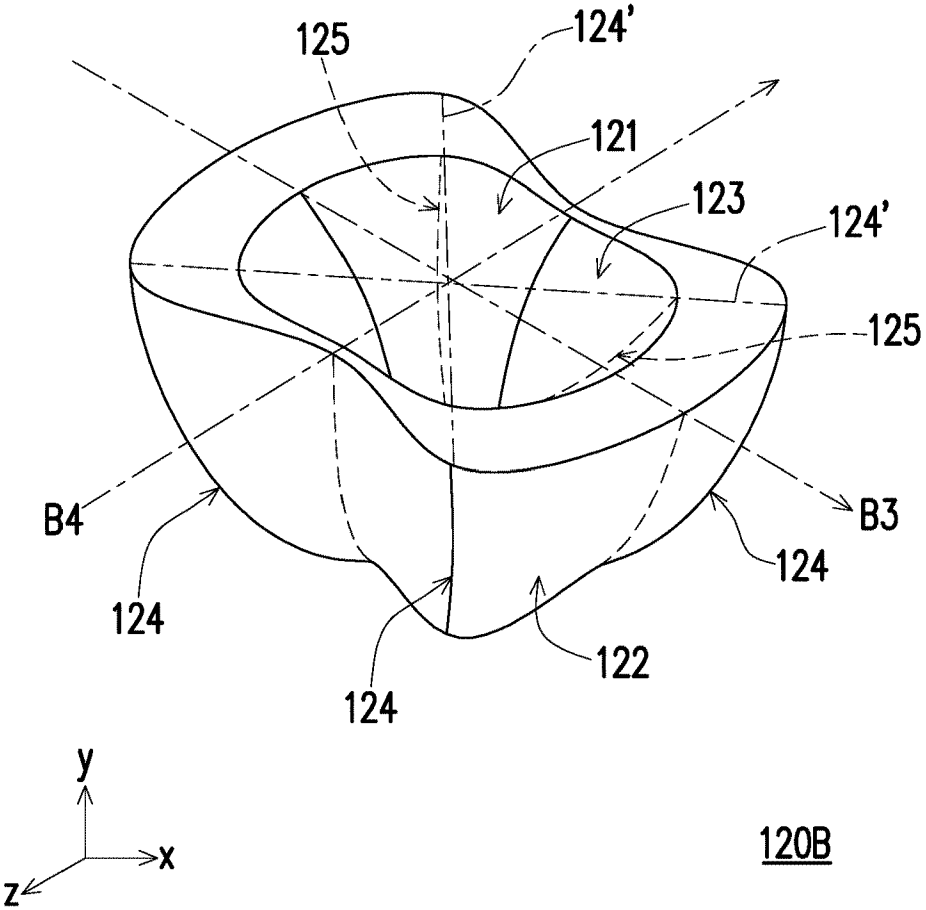
Figure 4D:
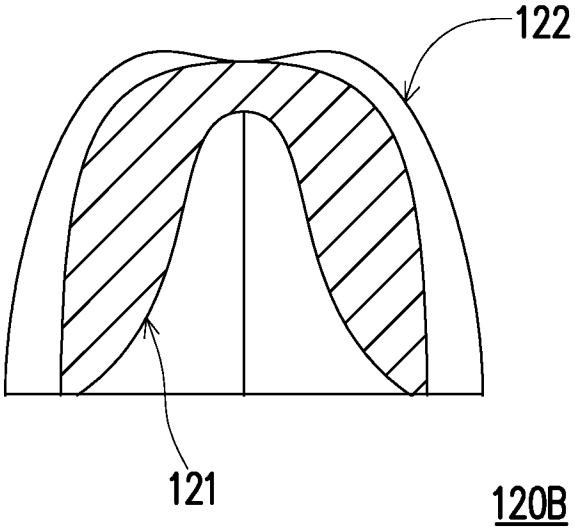
FIG. 4C and FIG. 4D are respectively cross-sections of the lens of FIG. 4B along a longitudinal direction B3 and a lateral direction B4.
Figure 4C:
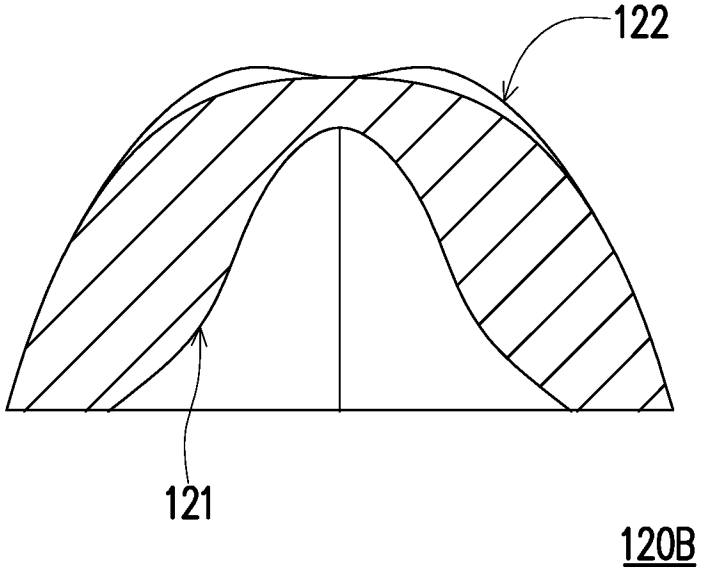
Figure 5B:
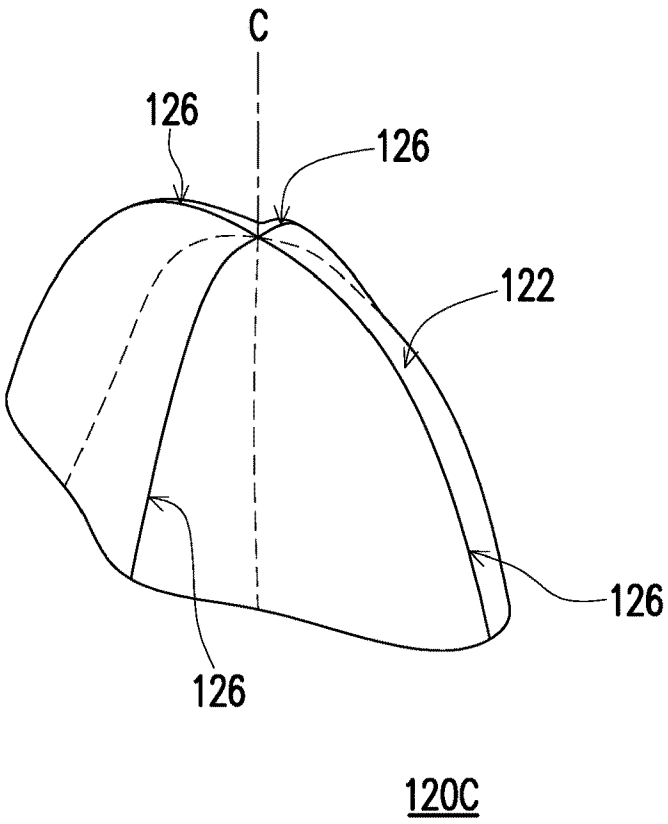
FIGS. 5A to 5B are perspective views of a lens of yet another embodiment of the invention.
Figure 5A:
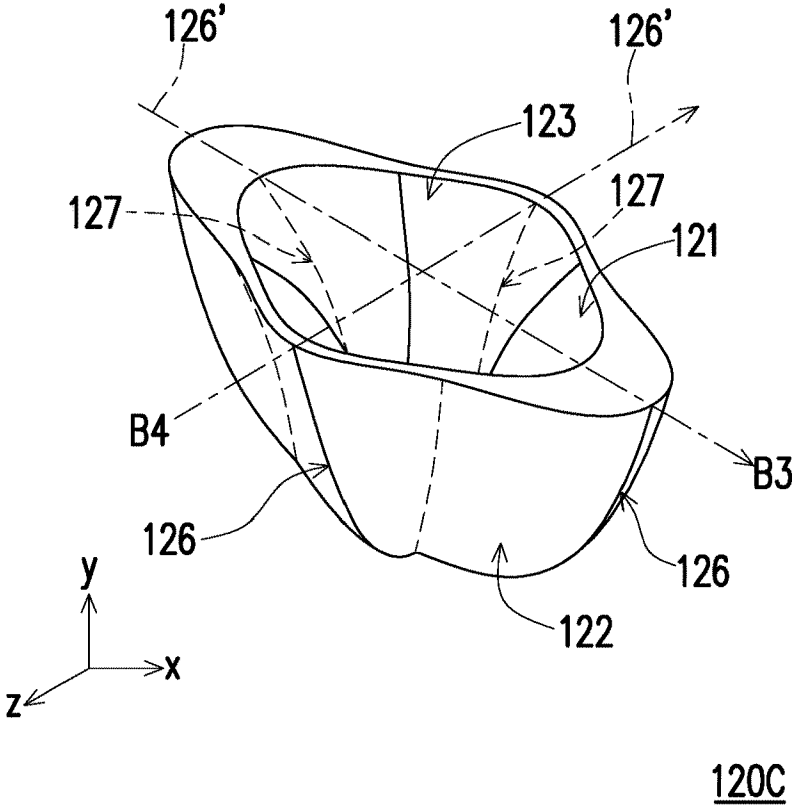
Figure 5D:
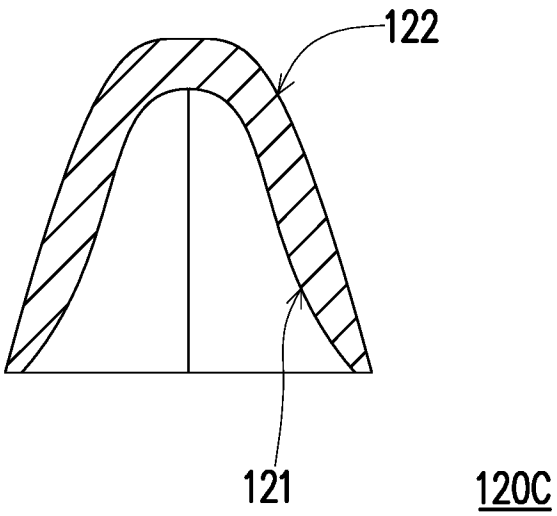
FIG. 5C and FIG. 5D are respectively cross-sections of the lens of FIG. 5B along the longitudinal direction B3 and the lateral direction B4.
Figure 5C:
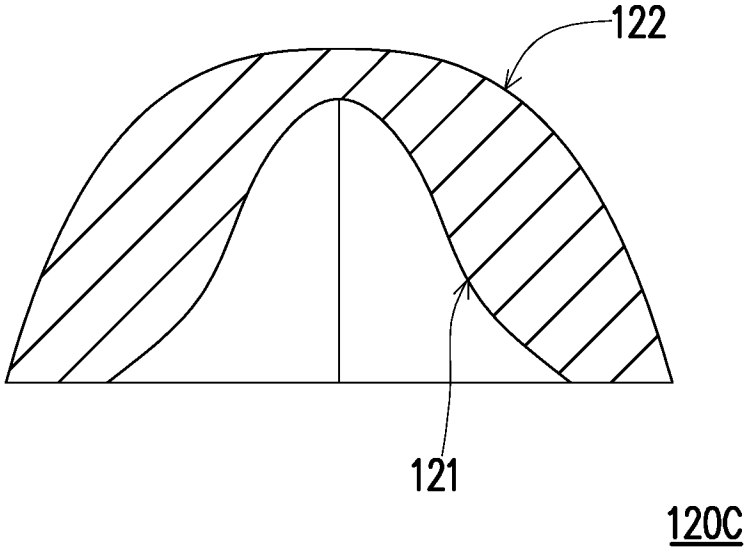
Figure 6B:
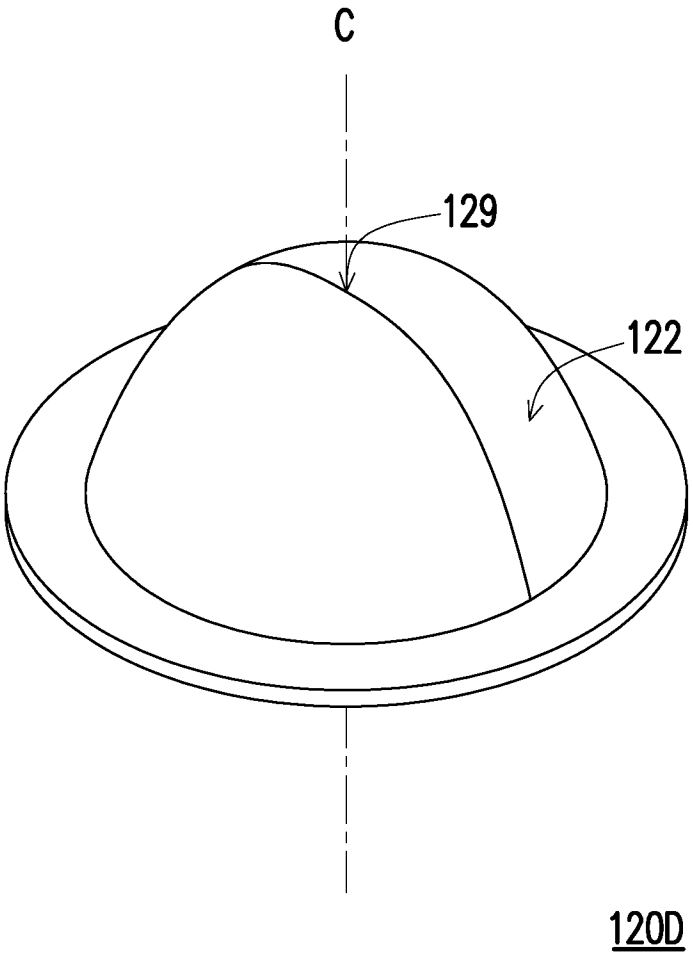
FIGS. 6A to 6B are perspective views of a lens of still yet another embodiment of the invention.
Figure 6A:
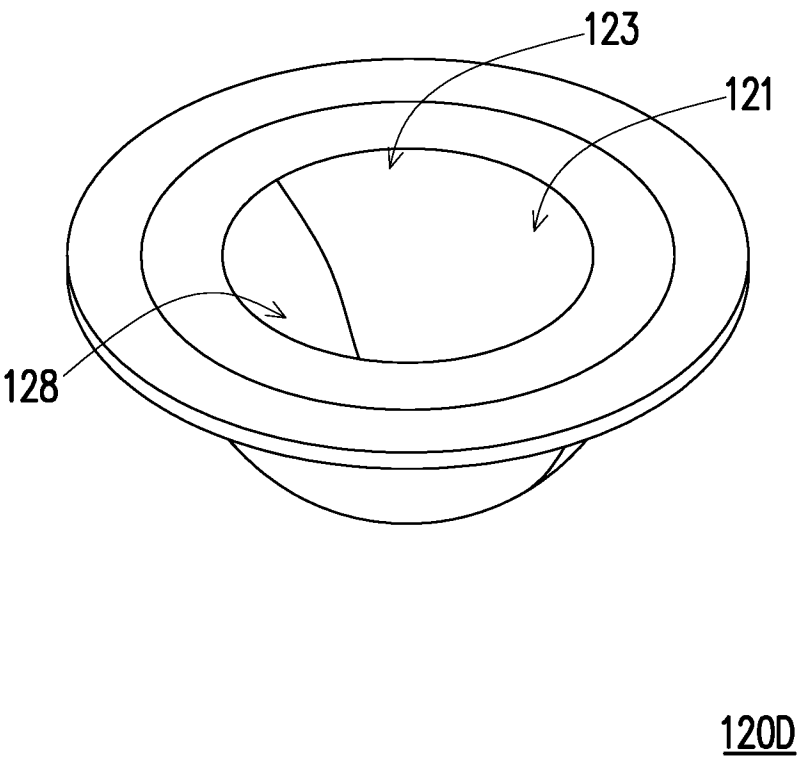
Figure 6C:
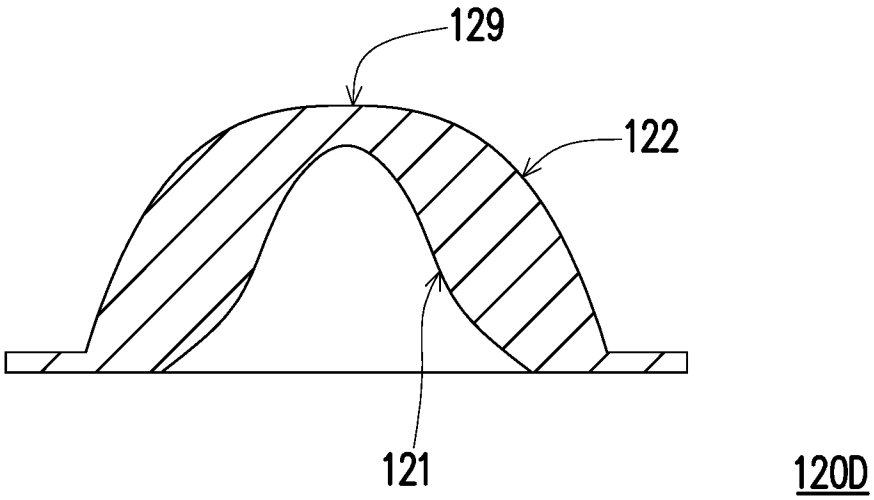
FIG. 6C is a cross-section of the lens of FIG. 6B.
Figure 7B:
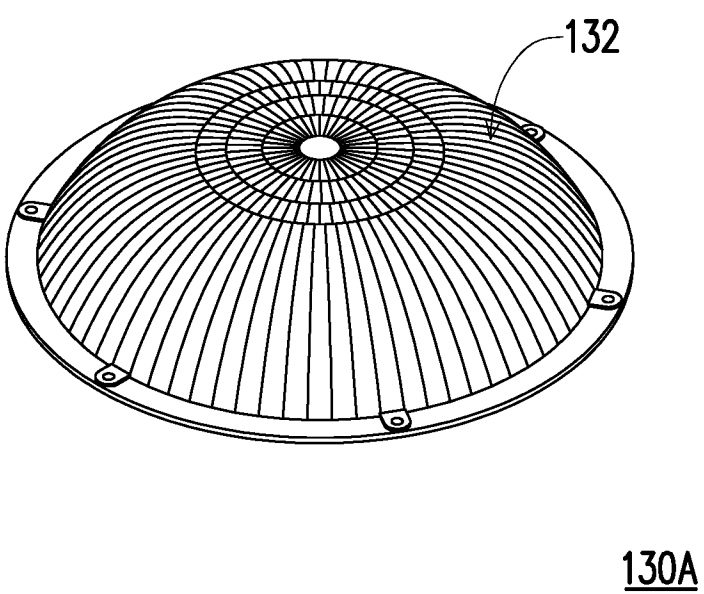
FIGS. 7A to 7B are perspective views of an optical cover of an embodiment of the invention.
Figure 7A:
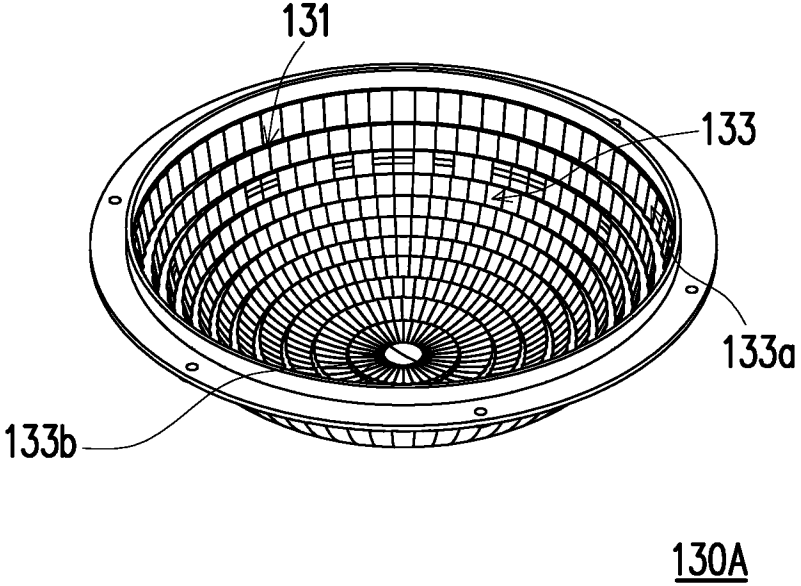
Figure 7C:
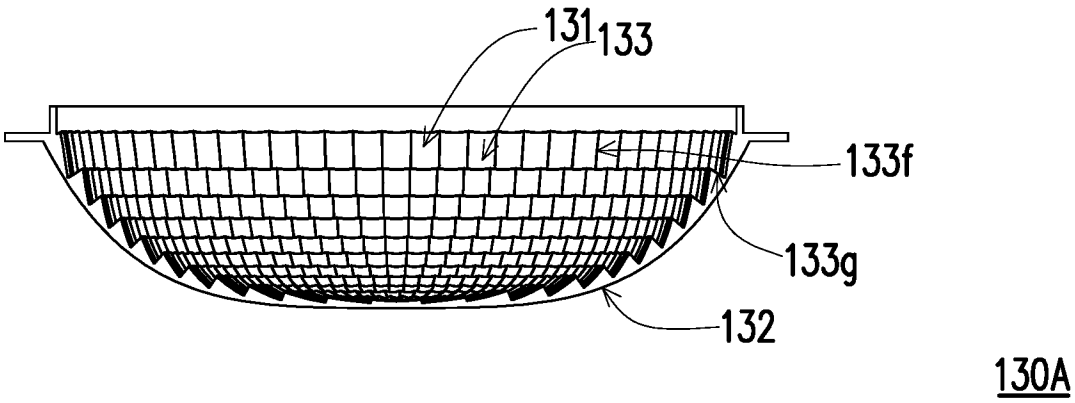
FIG. 7C is a cross-section of the optical cover of FIG. 7B.
Figure 7D:
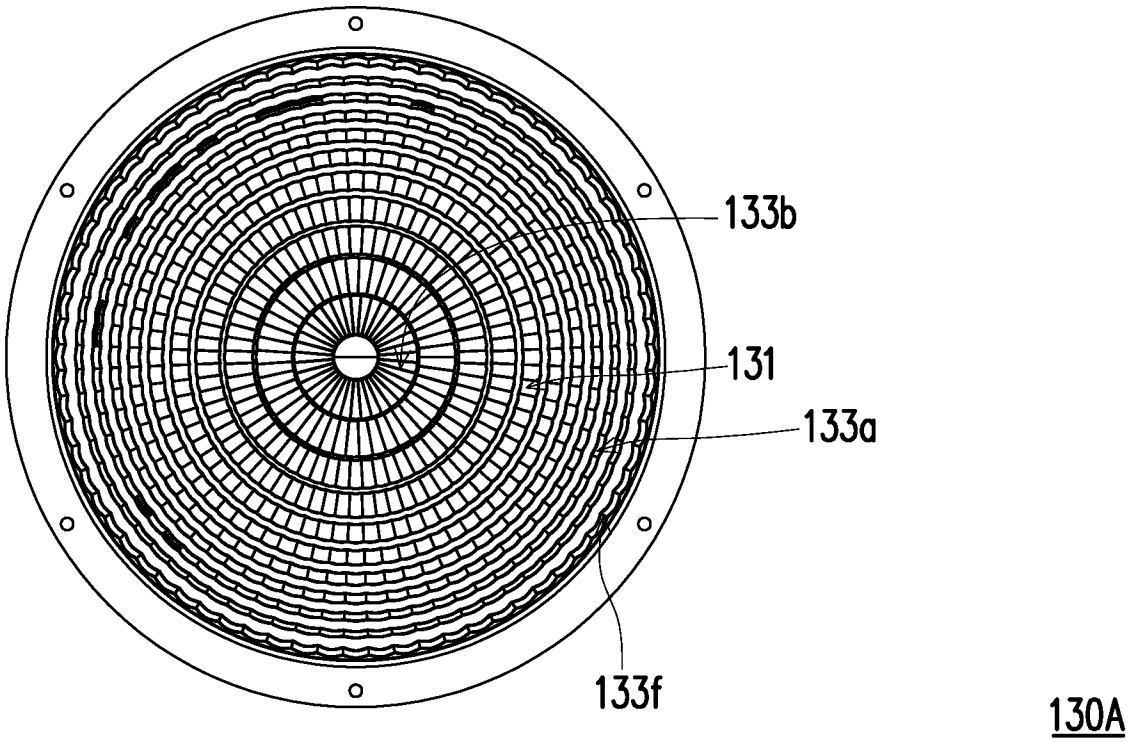
FIG. 7D is a top view of the optical cover of FIG. 7A.
Figure 8B:
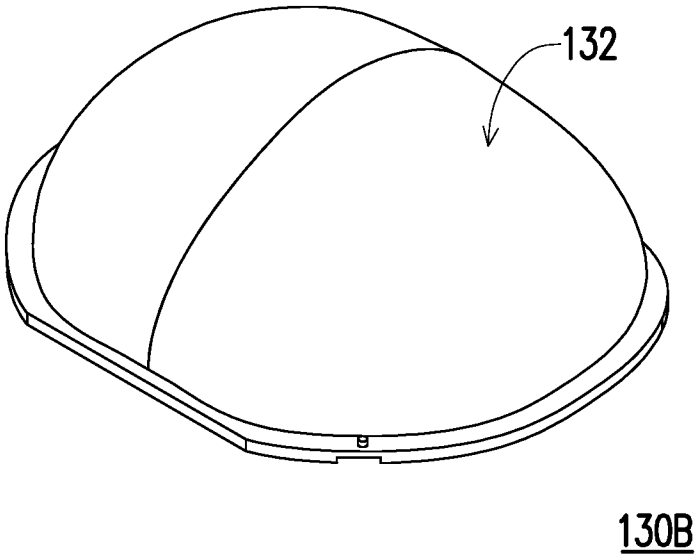
FIGS. 8A to 8B are perspective views of an optical cover of another embodiment of the invention.
Figure 8A:
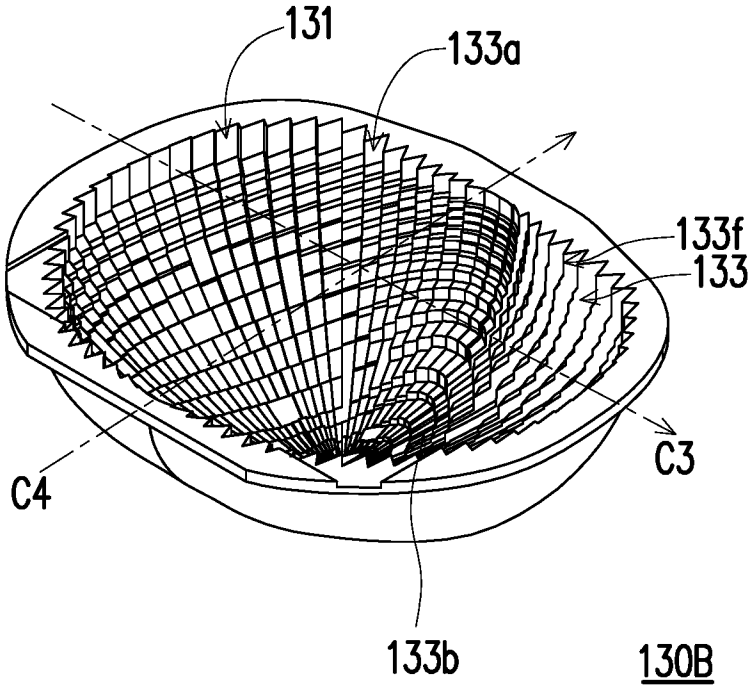
Figure 8D:
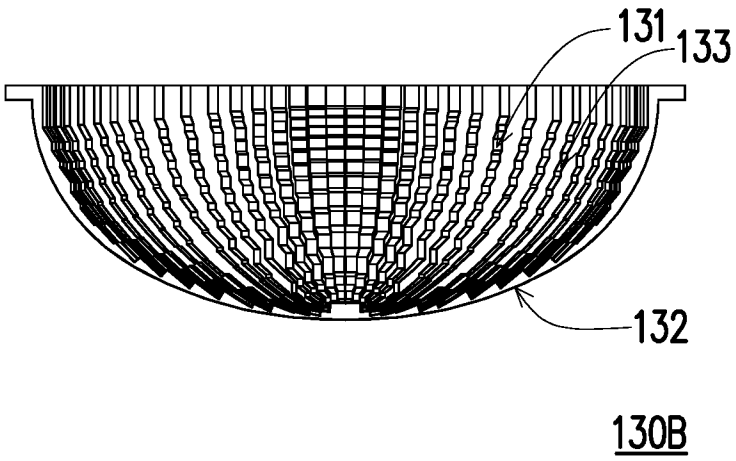
FIG. 8C and FIG. 8D are respectively cross-sections of the optical cover of FIG. 8B along a lateral direction C4 and a longitudinal direction C3.
Figure 8C:
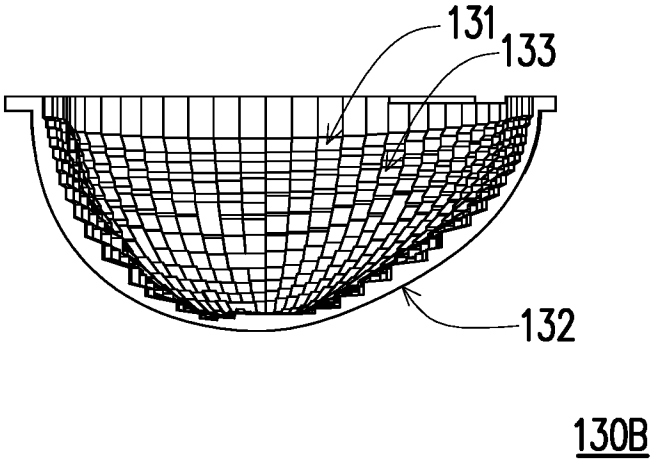
Figure 8E:
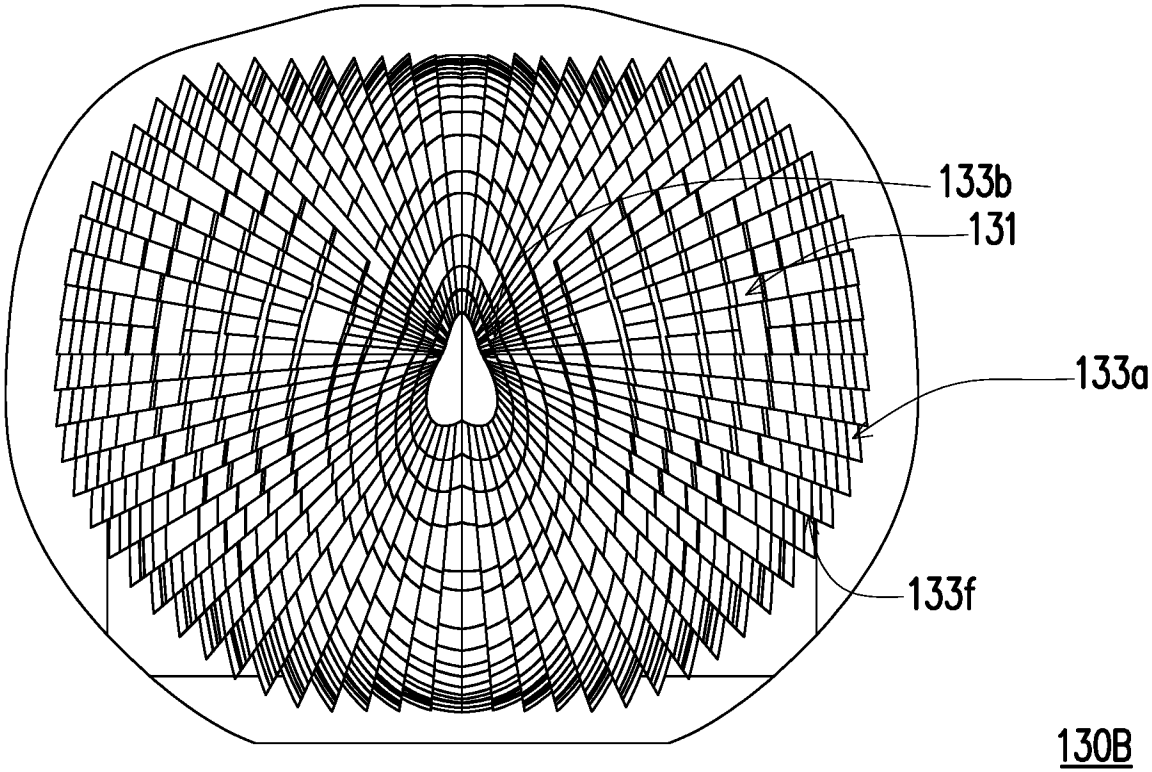
FIG. 8E is a top view of the optical cover of FIG. 8A.
Figure 9B:
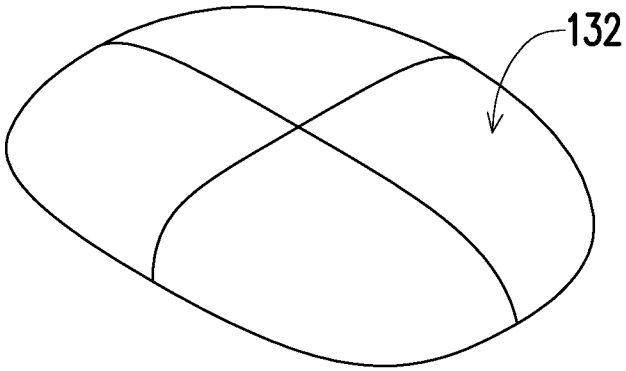
FIGS. 9A to 9B are perspective views of an optical cover of yet another embodiment of the invention.
Figure 9A:
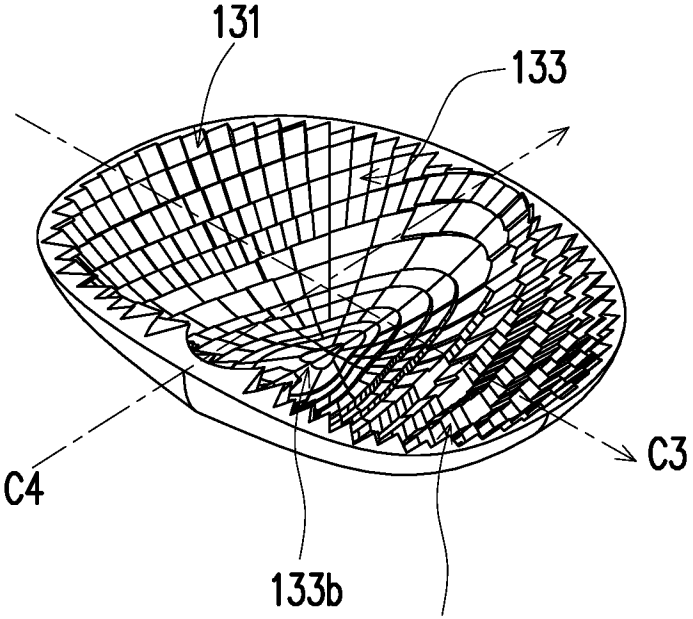
Figure 9D:
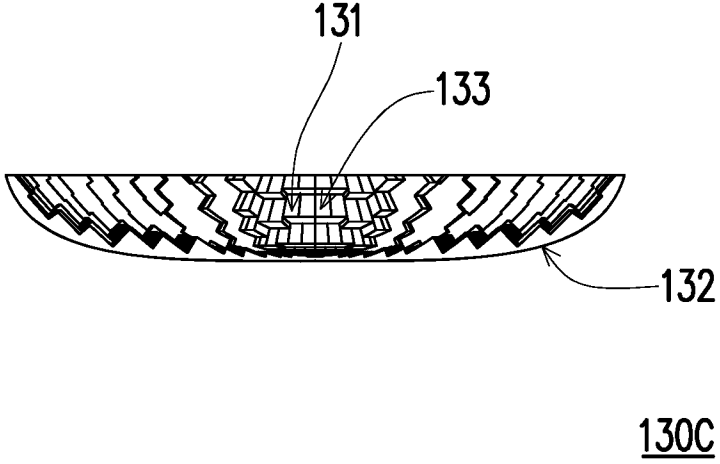
FIG. 9C and FIG. 9D are respectively cross-sections of the optical cover of FIG. 9B along the lateral direction C4 and the longitudinal direction C3.
Figure 9C:
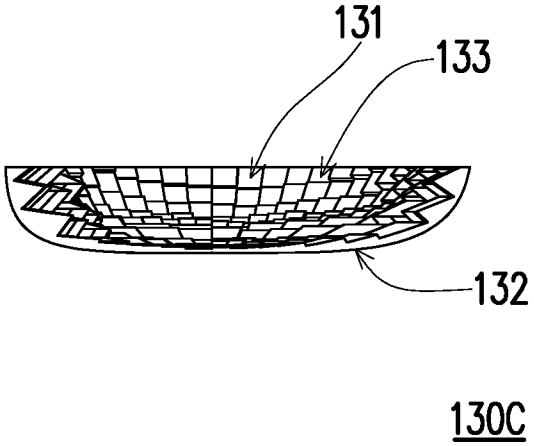
Figure 9E:
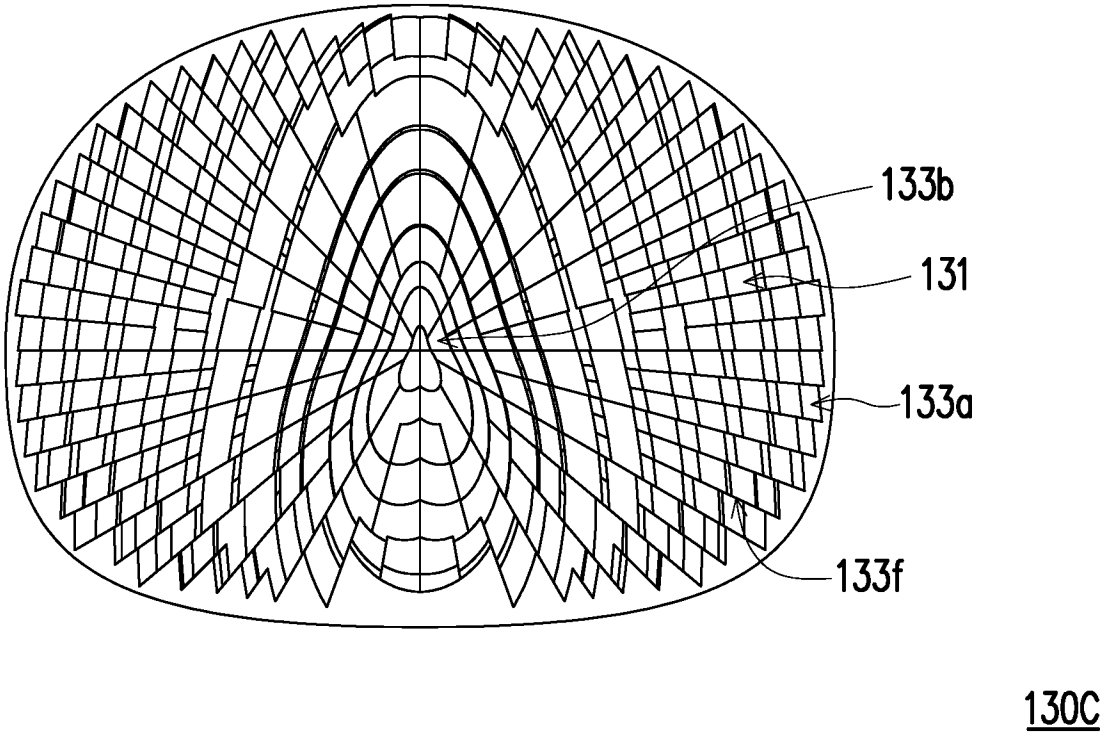
FIG. 9E is a top view of the optical cover of FIG. 9A.

FIG. 1A shows a side view of a lighting device of the first embodiment of the invention. FIG. 1B is a cross-section of the lighting device of FIG. 1A cut along an optical axis A. FIGS. 2A to 2C are schematics of three kinds of sub-curved surfaces of an optical cover in an embodiment of the invention. FIGS. 3A to 3B are perspective views of a lens of an embodiment of the invention. FIG. 3C and FIG. 3D are respectively cross-sections of the lens of FIG. 3B along a second long axis B2 and a first long axis B1. FIGS. 4A to 4B are perspective views of a lens of another embodiment of the invention. FIG. 4C and FIG. 4D are respectively cross-sections of the lens of FIG. 4B along a longitudinal direction B3 and a lateral direction B4. FIGS. 5A to 5B are perspective views of a lens of yet another embodiment of the invention. FIG. 5C and FIG. 5D are respectively cross-sections of the lens of FIG. 5B along the longitudinal direction B3 and the lateral direction B4. FIGS. 6A to 6B are perspective views of a lens of still yet another embodiment of the invention. FIG. 6C is a cross-section of the lens of FIG. 6B. FIGS. 7A to 7B are perspective views of an optical cover of an embodiment of the invention. FIG. 7C is a cross-section of the optical cover of FIG. 7B. FIG. 7D is a top view of the optical cover of FIG. 7A. FIGS. 8A to 8B are perspective views of an optical cover of another embodiment of the invention. FIG. 8C and FIG. 8D are respectively cross-sections of the optical cover of FIG. 8B along a lateral direction C4 and a longitudinal direction C3. FIG. 8E is a top view of the optical cover of FIG. 8A. FIGS. 9A to 9B are perspective views of an optical cover of yet another embodiment of the invention. FIG. 9C and FIG. 9D are respectively cross-sections of the optical cover of FIG. 9B along the lateral direction C4 and the longitudinal direction C3. FIG. 9E is a top view of the optical cover of FIG. 9A.

For convenience of explanation, the parallels of latitude of the optical cover in some drawings are only for illustration, and not all of them are drawn. For example, the parallels of latitude of the optical cover of FIG. 7B are only illustrated by three parallels of latitude.

Referring first to FIG. 1A and FIG. 1B, a lighting device 10 of the present embodiment includes a light source 110 and a light distribution module 100. The light distribution module 100 is configured to control the light distribution from the light source 110. The light distribution module 100 includes a lens 120 and an optical cover 130. The lens 120 has a first light-incident surface 121, a first light-emitting surface 122 opposite to the first light-incident surface 121, and an accommodating recess 123 located at a side of the first light-incident surface 121, wherein the accommodating recess 123 is configured to contain the light source 110. In the present embodiment, the lens 120 of FIG. 1B is a lens 120D of FIG. 6A. However, the invention is not limited thereto, and the lens 120 may be replaced by a lens 120A of FIG. 3A, a lens 120B of FIG. 4A, a lens 120C of FIG. 5A, or lenses of other shapes as needed.

The optical cover 130 covers the lens 120 and has a second light-incident surface 131 and a second light-emitting surface 132 opposite to the second light-incident surface 131, wherein the second light-incident surface 131 is located between the first light-emitting surface 122 and the second light-emitting surface 132, and the second light-incident surface 131 has a plurality of sub-curved surfaces 133. Boundaries 133*f* and 133*g* between adjacent sub-curved surfaces 133 are bent-shaped with respect to the adjacent sub-curved surfaces 133. One of the lens 120 and the optical cover 130 produces a first light shape that is rotationally symmetric or non-rotationally symmetric, and the other of the lens 120 and the optical cover 130 produces a second light shape that is rotationally symmetric. In the present embodiment, the optical cover 130 of FIG. 1B is an optical cover 130A of FIG. 7A. However, the invention is not limited thereto, and the optical cover 130 may be replaced by an optical cover 130B of FIG. 8A, an optical cover 130C of FIG. 9A, or other optical cover variations as needed.

In the present embodiment, the light source 110 is, for example, a light-emitting diode (LED). However, the invention is not limited thereto, and the light source 110 may also be a laser diode, an incandescent lamp, a mercury lamp, a halogen lamp, a fluorescent lamp, or other suitable light sources.

In the present embodiment, the lens 120 may be made of any suitable material such as polycarbonate (PC), polymethylmethacrylate (PMMA, aka-resin acrylic), silicone, or optical glass, and is preferably aka-resin acrylic, which has higher light-extraction efficiency and may be molded by injection molding. The optical cover 130 may be made of any suitable material such as polycarbonate, aka-resin acrylic, silicone, or glass, and is preferably polycarbonate, which has better weather resistance and may be molded by injection molding. In addition, for a large-sized light distribution module 100, the optical cover 130 may also be made of optical glass.

Moreover, in the present embodiment, the optical cover 130 may further be doped with a diffusing material to enhance the ability of the optical cover 130 to homogenize the light. The second light-emitting surface 132 of the optical cover 130 may be coated with a scratch-resistant hard coating to increase the structural strength of the optical cover 130.

Specific features of the optical cover 130 of the lighting device 10 in embodiments of the invention are described below.

Referring further to FIG. 1B, in the optical cover 130 of the lighting device 10 of the present embodiment, a thickness H1 from the center of the sub-curved surface that is near the edge of the optical cover 130 (such as a sub-curved surface 133*a*) to the second light-emitting surface 132 is greater than a thickness H2 from the center of the sub-curved surface that is near the center of the optical cover 130 (such as a sub-curved surface 133*b*) to the second light-emitting surface 132. In particular, the thickness between each of the sub-curved surfaces 133 and the second light-emitting surface 132 is gradually decreased along a direction from the edge of the optical cover 130 toward the center of the optical cover 130.

In addition, in the second light-incident surface 131 of the optical cover 130, boundaries 133*f* of adjacent sub-curved surfaces 133 arranged in the direction surrounding the optical axis A of the optical cover 130 have a ridge shape (for example, FIG. 1B, FIG. 2A to FIG. 2C, and FIG. 7D, wherein FIG. 7D clearly shows that the boundary 133*f* has a ridge shape), and the second light-incident surface 131 of the optical cover 130 has steps at the boundaries 133*g* of adjacent sub-curved surfaces arranged in the direction from the edge of the optical cover 130 to the center of the optical cover 130 (for example, FIG. 1B, FIG. 2A to FIG. 2C, and FIG. 7C, wherein FIG. 1B and FIG. 7C clearly show that the boundary 133*g* has a step).

It should be noted that, compared to the curved surface of a Fresnel lens that is a continuous smooth curved surface in the direction surrounding the optical axis, the second light-incident surface 131 of the optical cover 130 according to an embodiment of the present invention includes a plurality of sub-curved surfaces 133, wherein the boundaries 133*f* of the adjacent sub-curved surfaces 133 arranged in the direction surrounding the optical axis A of the optical cover 130 have a ridge shape. Therefore, the structure of the second light-incident surface 131 of the optical cover 130 of an embodiment of the invention is different from the structure of the Fresnel lens.

Furthermore, in the present embodiment, the sub-curved surfaces 133 of the optical cover 130 have the function of homogenizing light distribution. However the present invention is not limited thereto, and the sub-curved surfaces 133 may also be designed to concentrate light or produce other light shapes as needed. A specific embodiment in which the sub-curved surfaces 133 homogenize light distribution is described in detail below.

Referring to FIG. 2A to FIG. 2C, first, a dotted line in FIG. 2A and FIG. 2B indicates the line connecting the ridges of the boundaries 133*f* of the adjacent sub-curved surfaces 133 (e.g. the sub-curved surface 133*c* and the sub-curved surface 133*d*), and another dotted line indicates the extension line of the point where the sub-curved surface 133 (e.g. the sub-curved surface 133*c* and the sub-curved surface 133*d*) is the shortest distance from the second light-emitting surface 132, wherein the distance between the two dotted lines of the sub-curved surface 133*c* is 0.5 mm, and the distance between the two dotted lines of the sub-curved surface 133*d* is 1.0 mm. In addition, the angle between the lowest point of the curved surface and the highest point of the curved surface of the sub-curved surface 133*e* of FIG. 2C is 60 degrees.

TABLE 1

| | Divergence range | Divergence effect |
|---|---|---|
| Sub-curved surface 133c | 32 degrees | Low |
| Sub-curved surface 133d | 98 degrees | Medium |
| Sub-curved surface 133e | 110 degrees | High |

Table 1 shows the divergence effect of the sub-curved surface 133*c*, the sub-curved surface 133*d*, and the sub-curved surface 133*e*. Specifically, the light of a light source 110 is directed to a direction 45 degrees from the central axis B thereof to output the light of the light source 110 toward the optical cover 140, wherein the light of the light source 110 has an output angle range of 5 degrees. Therefore, the sub-curved surface 133*c* diverges the range of 5 degrees to 32 degrees, and the divergence effect thereof is low; the sub-curved surface 133*d* diverges the range of 5 degrees to 98 degrees, and the divergence effect thereof is medium; and the sub-curved surface 133*e* diverges the range of 5 degrees to 110 degrees, and the divergence effect thereof is high. Therefore, the sub-curved surface 133 of the optical cover 130 may be designed as one of the sub-curved surface 133*c*, the sub-curved surface 133*d*, and the sub-curved surface 133*e* according to environmental requirements to produce a desired light shape or divergence effect. However the present invention is not limited thereto, and the sub-curved surface 133 of the optical cover 130 may also be a combination of the sub-curved surface 133*c*, the sub-curved surface 133*d*, and the sub-curved surface 133*e* above to produce other specific light shapes.

Therefore, compared to the Fresnel lens that only has the function of focusing light, the optical cover 130 according to an embodiment of the present invention may produce the desired light shape distribution according to the structure of the sub-curved surface 133, and is not limited to concentrating or diverging light shape distribution.

One of the lens 120 and the optical cover 130 produces a first light shape that is rotationally symmetric or non-rotationally symmetric, and the other of the lens 120 and the optical cover 130 produces a second light shape that is rotationally symmetric. Specifically, the lens 120 produces a first light shape that is rotationally symmetric or non-rotationally symmetric, and the optical cover 130 produces a second light shape that is rotationally symmetric; alternatively, the optical cover 130 produces a first light shape that is rotationally symmetric or non-rotationally symmetric, and the lens 120 produces a second light shape that is rotationally symmetric.

In the following, the embodiment in which the lens 120 produces a first light shape that is rotationally symmetric or non-rotationally symmetric is first described, for example, in FIG. 3A to FIG. 6C, the lens 120A to the lens 120D are respectively a lens 120A that may produce a first light shape that is non-rotationally symmetric, a lens 120B that may produce a first light shape that is rotationally symmetric, a lens 120C that may produce a first light shape that is rotationally symmetric, and a lens 120D that may produce a first light shape that is axisymmetric, and an optical cover 130 that may produce a second light shape that is rotationally symmetric. For example, the optical cover 130A of FIG. 7A to FIG. 7C produces a second light shape that is rotationally symmetric.

In the present specification, "rotationally symmetric" means that each time after a pattern is rotated by an angle of less than 360 degrees around the axis of symmetry, the pattern coincides with the pattern before the rotation, and the pattern is a pattern that is rotationally symmetric. For example, a square is a 90-degree rotationally symmetric pattern (because the pattern of the square coincides with the pattern before the rotation after every 90 degrees of rotation), a rectangle is a 180-degree rotationally symmetric pattern, and a triangle is 120 degrees rotational symmetry. In addition, "axisymmetric" means that a pattern that rotates at any angle around the axis of symmetry coincides with the pattern before the rotation, that is, axisymmetry is an any-angle rotational symmetry, and an axisymmetric pattern is, for example, a circle.

First, referring to FIG. 3A to FIG. 3D, the lens 120A in the present embodiment has a first long axis B1 in the direction perpendicular to the central axis B of the light emitted by the light source 110, the accommodating recess 123 has a second long axis B2 in the direction perpendicular to the central axis B of the light emitted by the light source 110, the direction of the first long axis B1 is different from the direction of the second long axis B2, and the lens 120A produces a first light shape that is non-rotationally symmetric. In the present embodiment, the first long axis B1 is perpendicular to the second long axis B2, the first light-emitting surface 122 is non-mirror-symmetric in the direction perpendicular to the first long axis B1, and the accommodating recess 123 is non-mirror-symmetric in the direction of the second long axis B2. Further, in the present embodiment, the first light-emitting surface 122 is mirror-symmetric in the direction perpendicular to the second long axis B2, and the accommodating recess 123 is mirror-symmetric in the direction of the first long axis B1.

Referring further to FIG. 4A to FIG. 4D, the lens 120B in the present embodiment has a longitudinal direction B3 and a lateral direction B4. In FIG. 4A and FIG. 4B, the protrusions on the first light-emitting surface 122 are shown in solid lines, and the depressions are shown in dotted lines. That is, the first light-emitting surface 122 has a cross-shaped protrusion 124, and the extending directions of an orthographic projection 124' of the cross-shaped protrusion 124 on a reference plane (such as on the xz plane of FIG. 3A) perpendicular to an optical axis C of the lens 120B is tilted with respect to the longitudinal direction B3 and the lateral direction B4. In FIG. 4A, the protrusions on the first light-incident surface 121 are shown in solid lines, and the depressions are shown in dotted lines. That is, the first light-incident surface 121 has a cross-shaped depression 125, and the extending directions of the orthographic projection 124' of the cross-shaped depression 125 on a reference plane (such as on the xz plane of FIG. 4A) is tilted with respect to the longitudinal direction B3 and the lateral direction B4. In the present embodiment, the longitudinal direction B3 and the lateral direction B4 of the lens 120B are perpendicular to each other, and therefore the lens 120B produces a first light shape that is rotationally symmetric (such as 180-degree rotationally symmetric); in other embodiments, the longitudinal direction B3 and the lateral direction B4 of the lens 120B are not perpendicular to each other, such that the lens 120B may produce a first light shape that is non-rotationally symmetric.

Referring further to FIG. 5A to FIG. 5D, the lens 120C in the present embodiment has a longitudinal direction B3 and a lateral direction B4. In FIG. 5A and FIG. 5B, the protrusions on the first light-emitting surface 122 are shown in solid lines, and the depressions are shown in dotted lines. That is, the first light-emitting surface 122 has a cross-shaped protrusion 126, and the extending directions of an orthographic projection 126' of the cross-shaped protrusion 126 on a reference plane (such as on the xz plane of FIG. 5A) perpendicular to the optical axis C of the lens 120C are the same as the longitudinal direction B3 and the lateral direction B4. In FIG. 5A, the protrusions on the first light-incident surface 121 are shown in solid lines, and the depressions are shown in dotted lines. That is, the first light-incident surface 121 has a cross-shaped depression 127, and the extending directions of the orthographic projection 126' of the cross-shaped depression 127 on a reference plane (such as on the xz plane of FIG. 5A) are the same as the longitudinal direction B3 and the lateral direction B4. In the present embodiment, the longitudinal direction B3 and the lateral direction B4 of the lens 120C are perpendicular to each other, and therefore the lens 120C produces a first light shape that is rotationally symmetric (such as 180-degree rotationally symmetric); in other embodiments, the longitudinal direction B3 and the lateral direction B4 of the lens 120C are not perpendicular to each other, such that the lens 120C may produce a first light shape that is non-rotationally symmetric.

Referring further to FIG. 6A to FIG. 6C, the first light-incident surface 121 and the first light-emitting surface 122 of the lens 120D in the present embodiment are both axisymmetric, wherein a side surface 128 of the first light-incident surface 121 is steeper toward a vertex 129 of the first light-emitting surface 122.

Furthermore, referring to FIG. 7A to FIG. 7C, in the present embodiment, the second light-emitting surface 131 of the optical cover 130A is axisymmetric, wherein the sub-curved surfaces 133 are arranged in a multilayered annular shape around the optical axis A of the optical cover 130A, and the optical cover 130A produces a second light shape that is rotationally symmetric.

Based on the above, the lens 120A to the lens 120D of FIG. 3A to FIG. 6C may produce a first light shape that is rotationally symmetric or non-rotationally symmetric, and the optical cover 130A of FIG. 7A to FIG. 7C produces a second light shape that is rotationally symmetric. Therefore, the light distribution module 100 of the present embodiment may adopt one of the above four types of lenses 120A to 120D to be combined with the optical cover 130A as needed, that is, the lighting device 10 of the present embodiment may produce four different light shapes from different combinations. It is worth mentioning that the lens 120D may produce an axisymmetric light shape, and the optical cover 130A may also produce a rotationally symmetric light shape, and therefore in the combination of the lens 120D and the optical cover 130A, the lens 120D may produce an axisymmetric first light shape (or second light shape) and the optical cover 130A may produce a rotationally symmetric second light shape (or first light shape).

The following further illustrates that the lens 120 produces a rotationally symmetric second light shape, such as the embodiment of FIG. 6A to FIG. 6C in which the lens 120D may produce an axisymmetric second light shape and the optical cover 130 produces a rotationally symmetric or non-rotationally symmetric first light shape. For example, the optical covers 130B and 130C of FIG. 8A to FIG. 9E may produce a mirror-symmetric first light shape.

First, referring to FIG. 6A to FIG. 6C, the lens 120D of the present embodiment may produce an axisymmetric second light shape. The same features are provided in the above description, and thus are not repeated herein.

Furthermore, referring further to FIG. 8A to FIG. 9E, the optical covers 130B and 130C in the present embodiment have a longitudinal direction C3 and a lateral direction C4. The optical covers 130B and 130C are mirror-symmetric in the longitudinal direction C3, and are non-mirror-symmetric in the lateral direction C4, and the optical covers 130B and 130C produce a first light shape that is non-rotationally symmetric, wherein the sub-curved surfaces 133 are mirror symmetric in the longitudinal direction C3 and are arranged in a non-mirror-symmetric multilayered annular shape in the lateral direction C4. Some layers arranged in the multilayered annular shape near the center of the optical covers 130B and 130C (such as near the sub-curved surface 133*b*) are heart-shaped rings. Further, in the present embodiment, the optical cover 130B of FIG. 8A is different in height from the optical cover 130C of FIG. 9A. In other words, the thickness of the lighting device with the optical cover 130B of FIG. 8A is greater than the thickness of the lighting device with the optical cover 130C of FIG. 9A.

The lens 120D based on FIG. 6A to FIG. 6C above may produce a second light shape that is axisymmetric, and the optical covers 130B and 130C of FIG. 8A to FIG. 9E may produce a first light shape that is mirror-symmetric. Therefore, the light distribution module 100 of the present embodiment may adopt one of the two types of optical covers 130B and 130C to be combined with the lens 120D as needed, that is, the light distribution module 100 of the present embodiment may produce two different light shapes via different combinations.

It should be noted that, according to the above embodiments, there are four embodiments in which the lens is the first light shape and the optical cover is the second light shape, and there are two embodiments in which the lens is the second light shape and the optical cover is the first light shape, and therefore a total of six light distribution modules 100 with different light shapes may be formed. However, the invention is not limited thereto, and the width to height ratio of the optical cover may also be designed according to the actual requirements of the light shape or the light distribution.

The features of the light distribution that may be produced by the lens 120 and the optical cover 130 in accordance with the above embodiments of the invention are first described below, followed by an embodiment in which the optical cover has a different width to height ratio.

Figure 10:
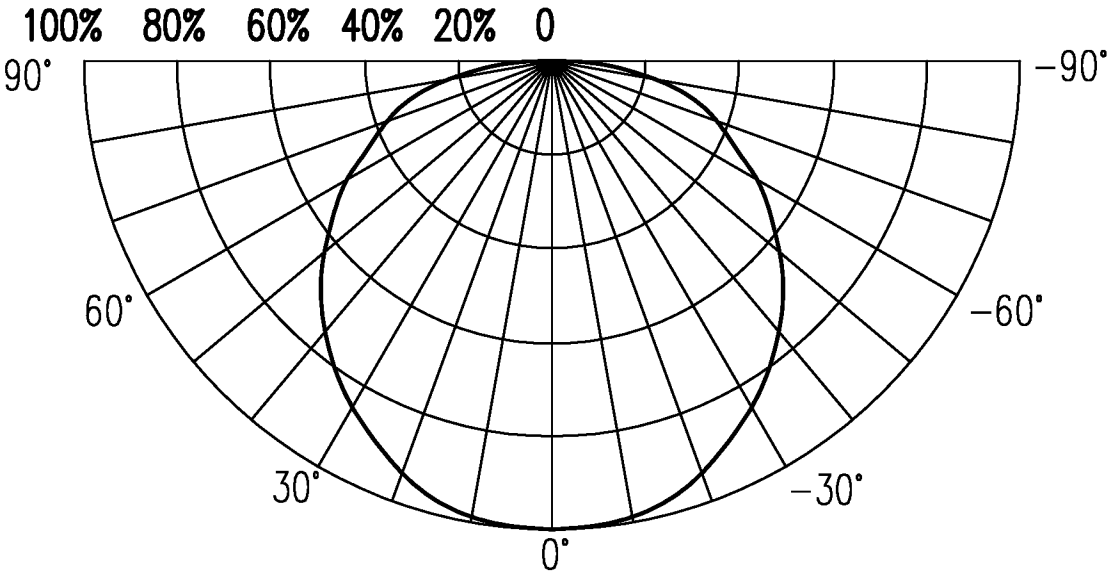
FIG. 10 is a light shape distribution of a light source in an embodiment of the invention.
Figure 11B:
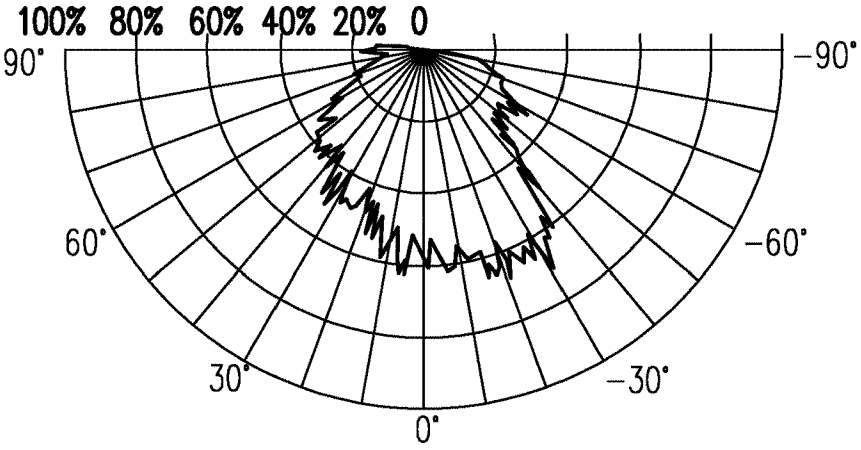
FIG. 11A and FIG. 11B are light shape distributions respectively produced in the direction of the first long axis B1 and the direction of the second long axis B2 after the light source of FIG. 10 passes through the lens of FIG. 3A.
Figure 11A:
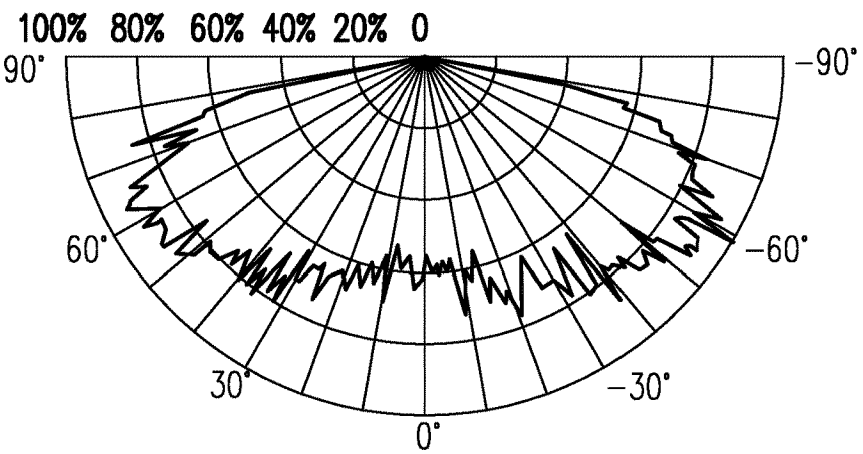
Figure 11D:
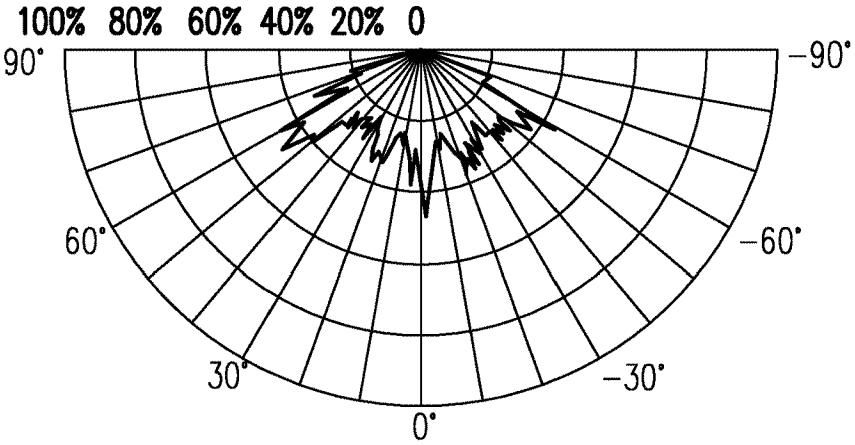
FIG. 11C and FIG. 11D are respectively light shape distributions produced after the light shapes of FIG. 11A and FIG. 11B pass through the optical cover of FIG. 7A.
Figure 11C:
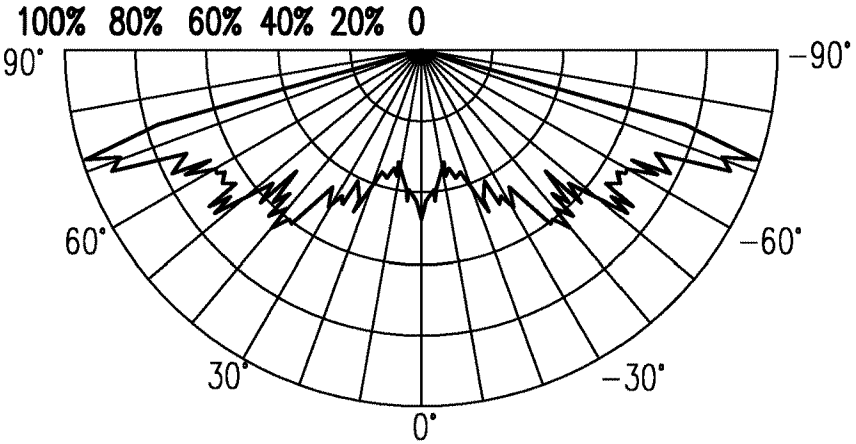
Figure 12B:
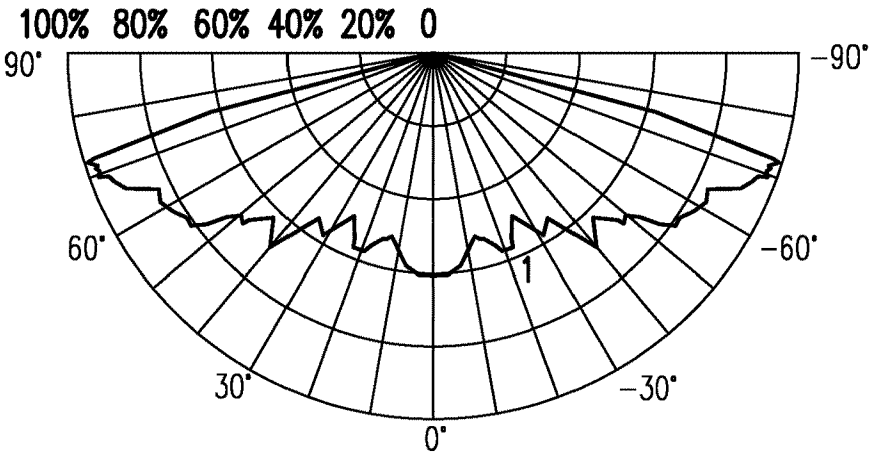
FIG. 12B is a light shape distribution produced after the light shape of FIG. 12A further passes through the optical cover of FIG. 7A.
Figure 12A:
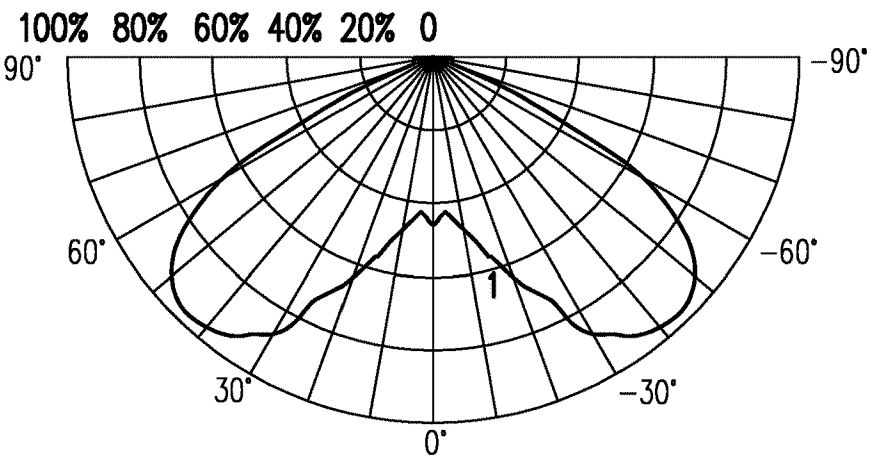
FIG. 12A is a light shape distribution produced after the light source of FIG. 10 passes through the lens of FIG. 6A.

FIG. 10 is a light shape distribution of a light source in an embodiment of the invention. FIG. 11A and FIG. 11B are light shape distributions respectively produced in the direction of the first long axis B1 and the direction of the second long axis B2 after the light source of FIG. 10 passes through the lens of FIG. 3A. FIG. 11C and FIG. 11D are respectively light shape distributions produced after the light shapes of FIG. 11A and FIG. 11B pass through the optical cover of FIG. 7A. FIG. 12A is a light shape distribution produced after the light source of FIG. 10 passes through the lens of FIG. 6A. FIG. 12B is a light shape distribution produced after the light shape of FIG. 12A further passes through the optical cover of FIG. 7A.

Referring to FIG. 10 to FIG. 11D, the light source of FIG. 10 is a light-emitting diode. As shown in FIG. 10, the light shape of the selected light source is more concentrated, and therefore the ability of the lens 120 and the optical cover 130 to produce a light shape may be detected. Then, since the lens 120A has mirror symmetry in the direction of the first long axis B1 (for example, FIG. 3D), the light shape of FIG. 11A also has mirror symmetry; conversely, since the lens 120A does not have symmetry in the direction of the second long axis B2 (for example, FIG. 3C), the light shape of FIG. 11B also does not have symmetry. It is worth mentioning that the distribution of the light shapes of FIG. 11C and FIG. 11D is more uniform than that of FIG. 11A and FIG. 11B, and therefore the sub-curved surfaces 133 of the optical cover 130A have the effect of homogenizing light distribution.

Referring further to FIG. 10, FIG. 12A, and FIG. 12B, since both the lens 120D and the optical cover 130A used in FIG. 12A and FIG. 12B have rotational symmetry, both the lens 120D and the optical cover 130A may produce a light shape having rotational symmetry. Similar to the distribution of the light shapes of FIG. 11C and FIG. 11D above, the distribution of the light shape of FIG. 12B is also more average compared to FIG. 12A, and therefore it is also known that the sub-curved surfaces 133 of the optical cover 130A have the function of homogenizing light distribution.

Next, light distributions (light energy distribution, that is, an iso-illuminance curve diagram) that may be produced according to the combination of the lens and the optical cover in the above embodiments are briefly described. In the following, the light distribution of the embodiment in which the lens produces a first light shape that is rotationally symmetric or non-rotationally symmetric and the optical cover produces a second light shape that is rotationally symmetric is first described, and then the light distribution of the embodiment in which the optical cover produces a first light shape that is rotationally symmetric or non-rotationally symmetric and the lens produces a second light shape that is rotationally symmetric is described.

Figure 13B:
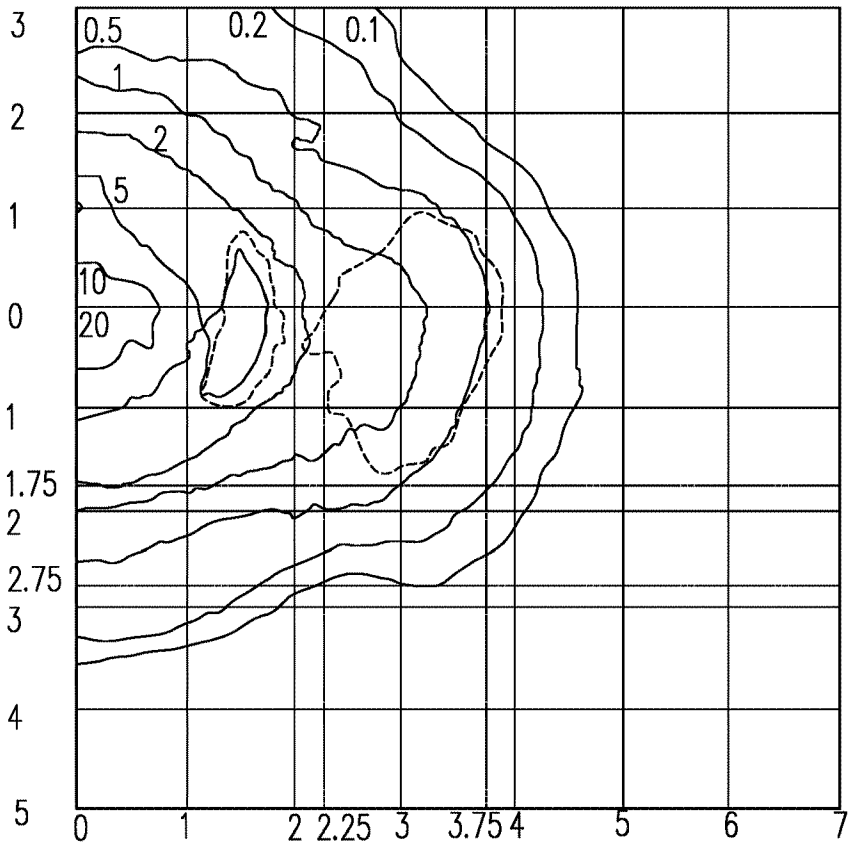
FIG. 13B is an iso-illuminance curve diagram of a light distribution produced by the light distribution of FIG. 13A after further passing through the optical cover of FIG. 7A.
Figure 13A:
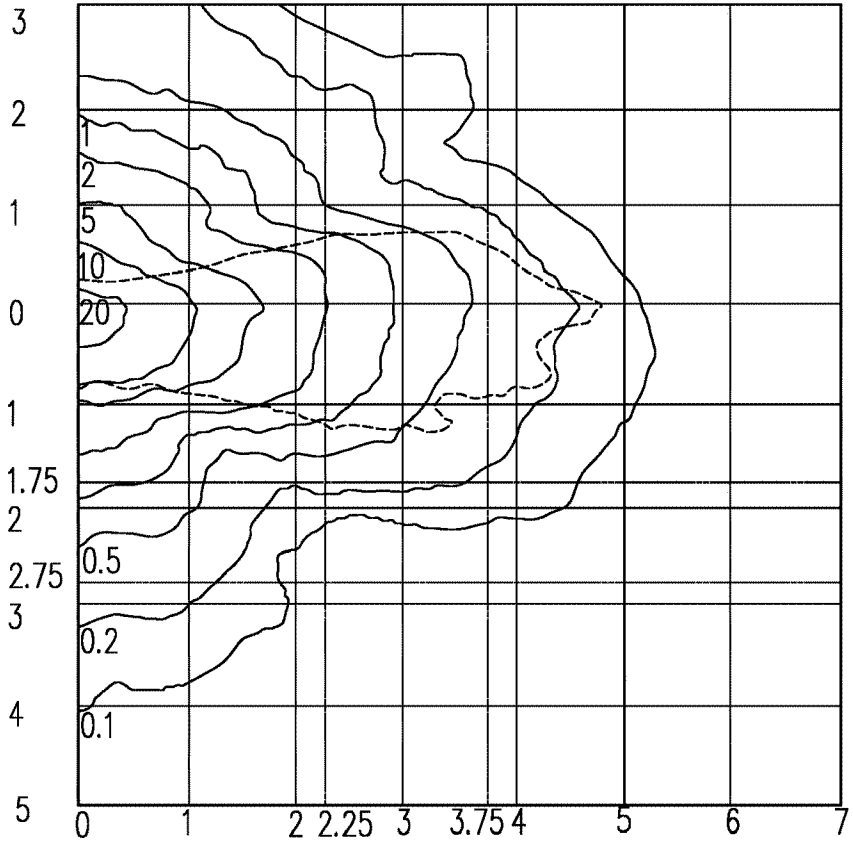
FIG. 13A is an iso-illuminance curve diagram of a light distribution produced after the light source of FIG. 10 passes through the lens of FIG. 3A.
Figure 14B:
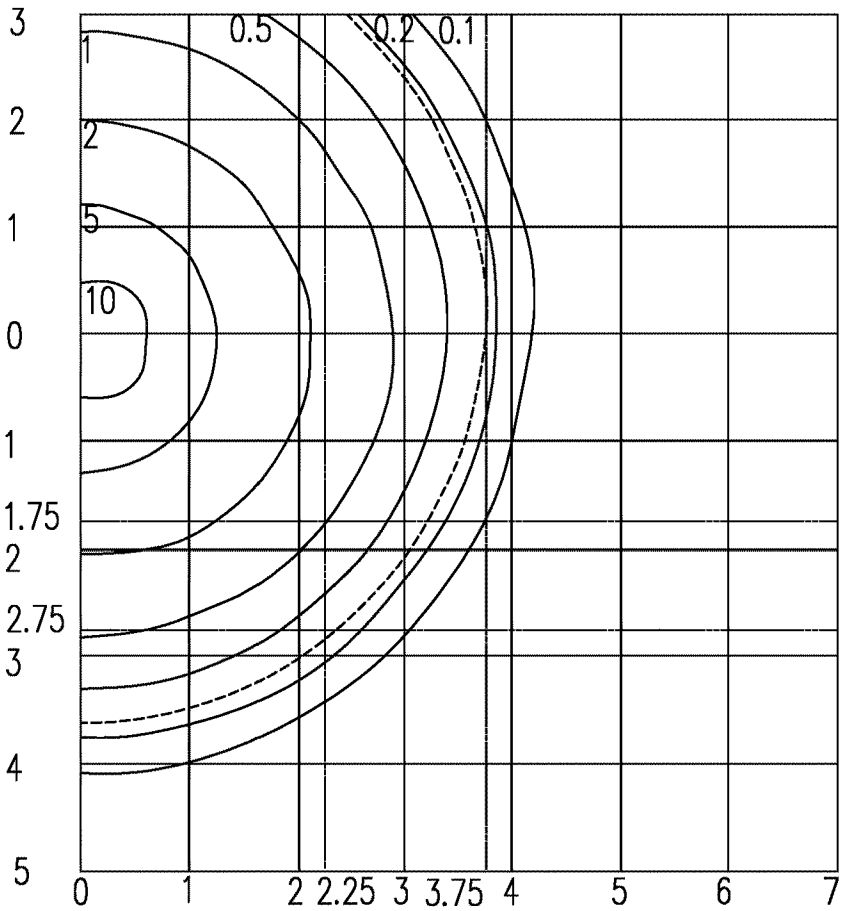
FIG. 14B is an iso-illuminance curve diagram of a light distribution produced by the light distribution of FIG. 14A after further passing through the optical cover of FIG. 7A.
Figure 14A:
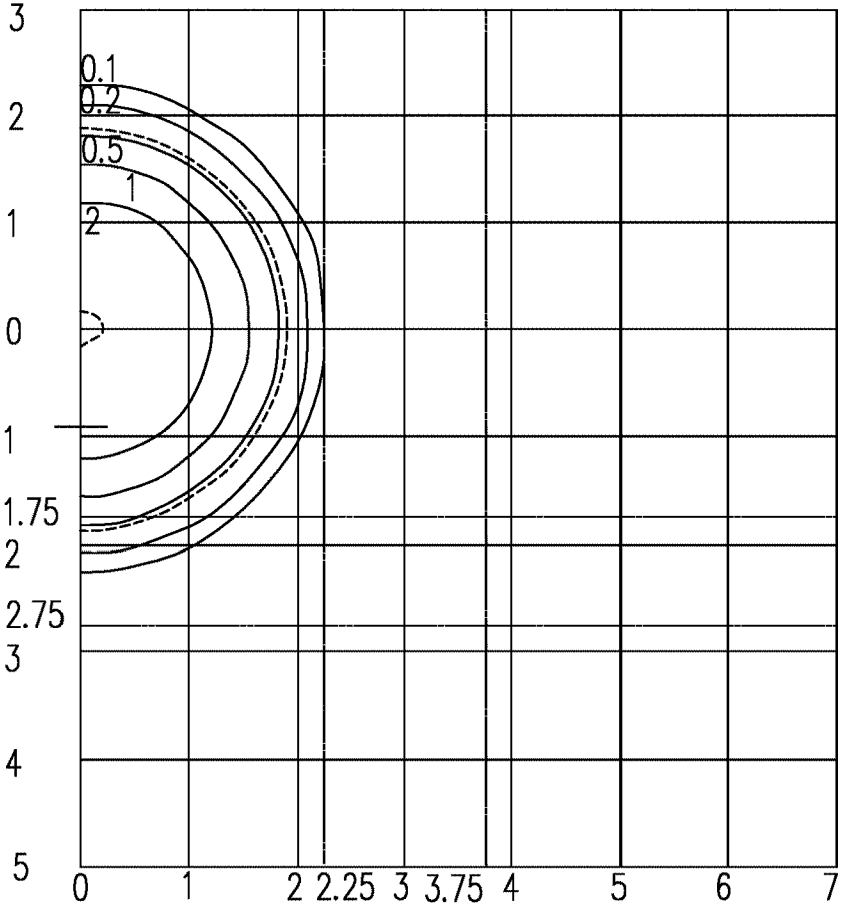
FIG. 14A is an iso-illuminance curve diagram of a light distribution produced after the light source of FIG. 10 passes through the lens of FIG. 6A.
Figure 15B:
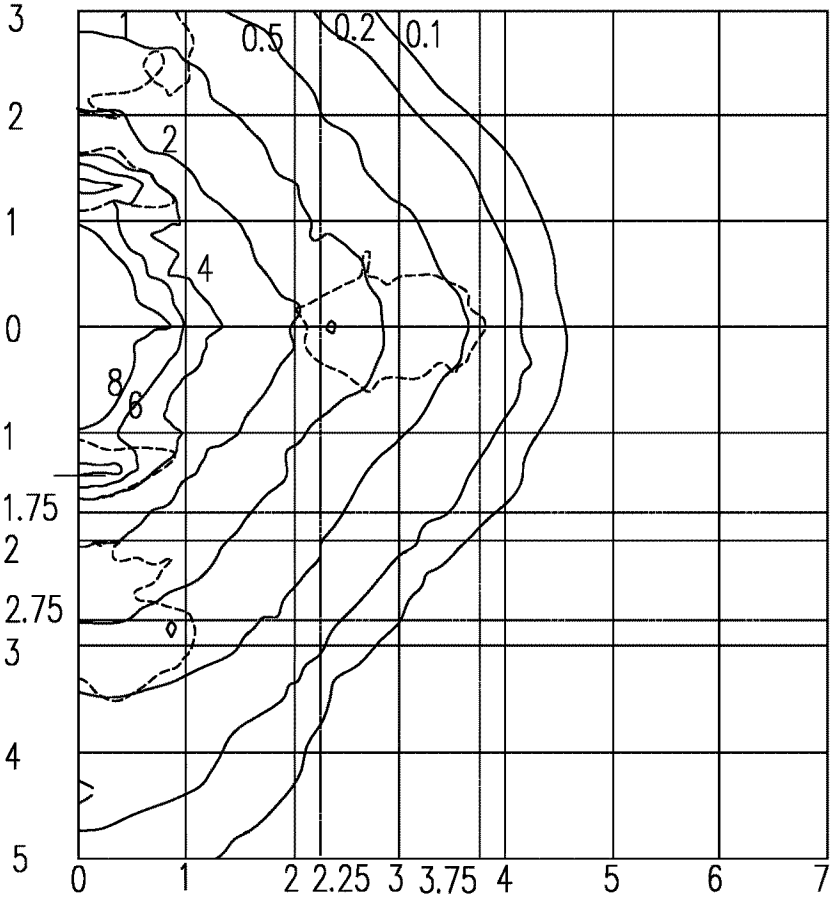
FIG. 15B is an iso-illuminance curve diagram of a light distribution produced by the light source of FIG. 10 after first passing through the lens of FIG. 5A and then passing through the optical cover of FIG. 7A.
Figure 15A:
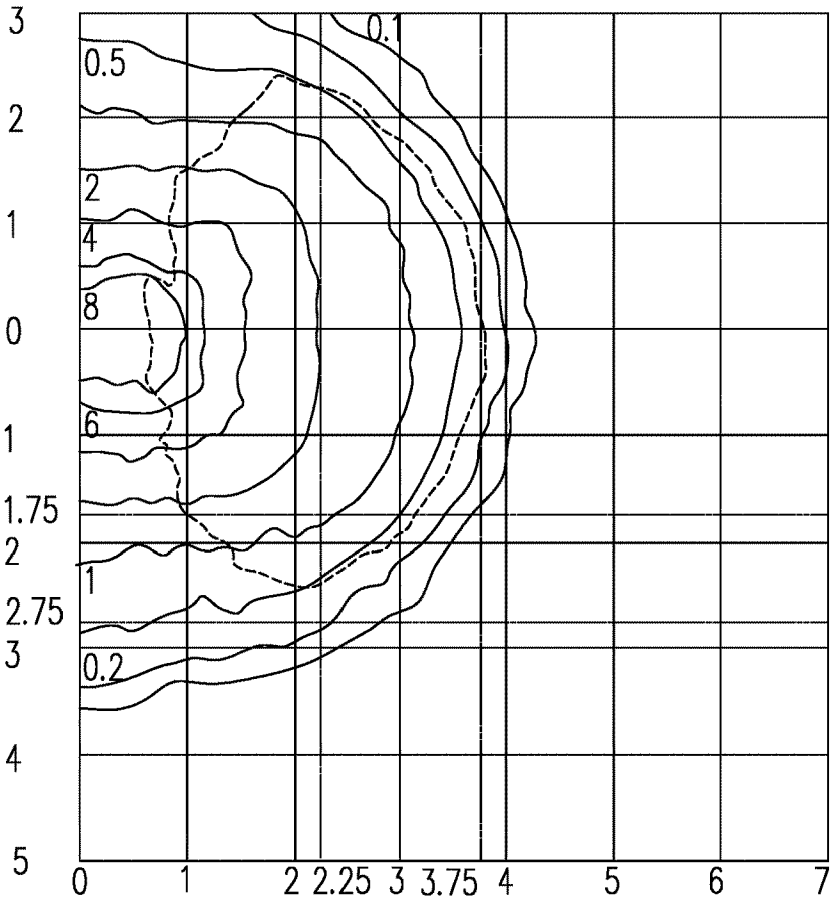
FIG. 15A is an iso-illuminance curve diagram of a light distribution produced by the light source of FIG. 10 after first passing through the lens of FIG. 4A and then passing through the optical cover of FIG. 7A.

FIG. 13A is an iso-illuminance curve diagram of a light distribution produced after the light source of FIG. 10 passes through the lens of FIG. 3A. FIG. 13B is an iso-illuminance curve diagram of a light distribution produced by the light distribution of FIG. 13A after further passing through the optical cover of FIG. 7A. FIG. 14A is an iso-illuminance curve diagram of a light distribution produced after the light source of FIG. 10 passes through the lens of FIG. 6A. FIG. 14B is an iso-illuminance curve diagram of a light distribution produced by the light distribution of FIG. 14A after further passing through the optical cover of FIG. 7A. FIG. 15A is an iso-illuminance curve diagram of a light distribution produced by the light source of FIG. 10 after first passing through the lens of FIG. 4A and then passing through the optical cover of FIG. 7A. FIG. 15B is an iso-illuminance curve diagram of a light distribution produced by the light source of FIG. 10 after first passing through the lens of FIG. 5A and then passing through the optical cover of FIG. 7A.

First, the light distribution of the embodiment in which the lens produces a first light shape that is rotationally symmetric or non-rotationally symmetric and the optical cover produces a second light shape that is rotationally symmetric is described. In the diagram of the iso-illuminance curves, the unit of the horizontal axis and the vertical axis is the height at which the light distribution module according to the embodiment of the invention is set, such as a height of 10 feet, and the number indicated next to the iso-illuminance curve is illuminance with a unit of fc ($Lm/ft^2$, that is, lumen per square foot). In addition, the dotted line is the connecting line of half the maximum intensity.

Referring first to FIG. 13A and FIG. 13B, the light distributions of FIG. 13A and FIG. 13B not only have an asymmetric characteristic, but the light distributions thereof are also more concentrated at the top in the vertical axis. Therefore, if applied in a road lighting device, the light distribution may be configured such that the bottom of the vertical axis of FIG. 13A and FIG. 13B is toward the side of the sidewalk (or the side of the house) and the top of the vertical axis of FIG. 13A and FIG. 13B is toward the side of the lane. That is, both the lane and the sidewalk are lighted, and the light distribution range on the side of the lane is smaller, while the light distribution range on the side of the sidewalk is larger.

Next, referring to FIG. 14A and FIG. 14B, since both the lens 120D of FIG. 6A and the optical cover 130A of FIG. 7A have rotational symmetry, the light distributions of FIG. 14A and FIG. 14B also have rotational symmetry.

Furthermore, referring to FIG. 15A and FIG. 15B at the same time, if FIG. 15A is compared with FIG. 15B, the light distribution of FIG. 15B is more uniform, which is more suitable for general wide-range lighting; and the light distribution of FIG. 15A is more narrow, long, and concentrated, which is suitable for narrow road/alley lighting. Besides, when the lighting device is disposed on the side of a road, projecting light in a direction perpendicular to the road may reduce the light energy projected onto the houses on the side of the road.

Next, the light distribution of the embodiment in which the optical cover produces a first light shape that is rotationally symmetric or non-rotationally symmetric and the lens produces a second light shape that is rotationally symmetric is described.

Figure 16B:
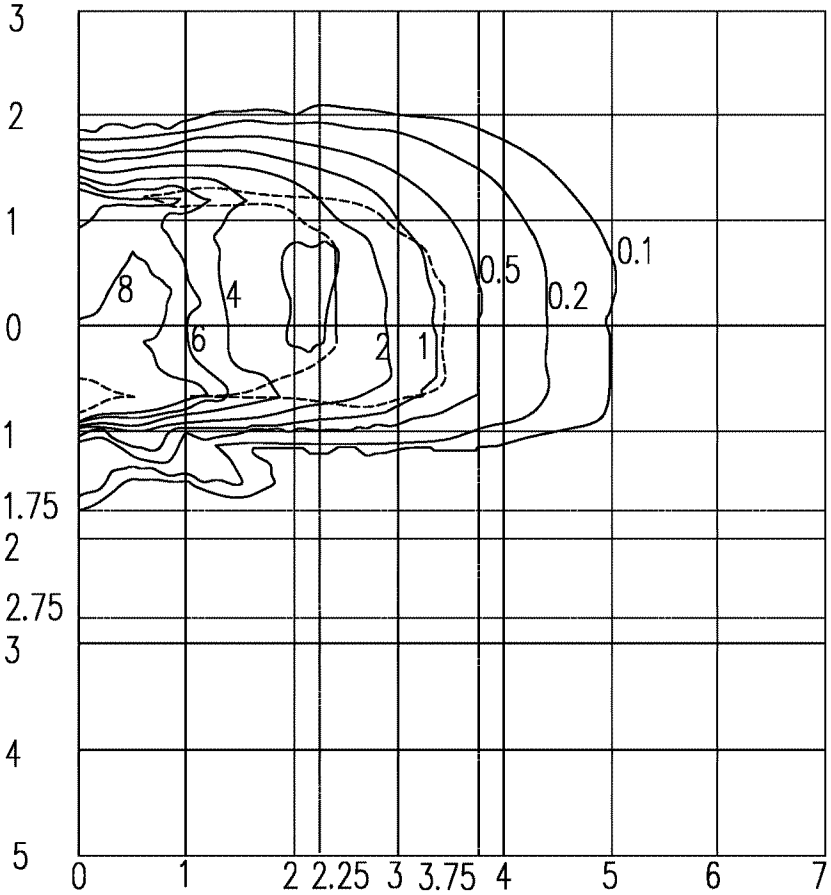
FIG. 16B is an iso-illuminance curve diagram of a light distribution produced by the light source of FIG. 10 after first passing through the lens of FIG. 6A and then passing through the optical cover of FIG. 9A.
Figure 16A:
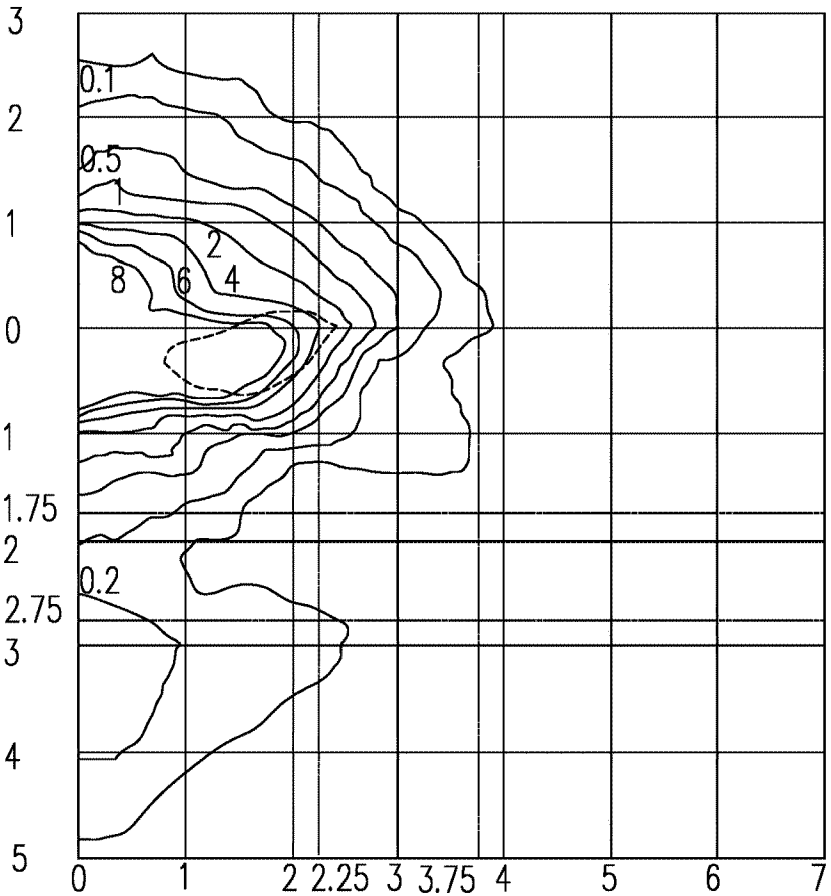
FIG. 16A is an iso-illuminance curve diagram of a light distribution produced by the light source of FIG. 10 after first passing through the lens of FIG. 6A and then passing through the optical cover of FIG. 8A.

FIG. 16A is an iso-illuminance curve diagram of a light distribution produced by the light source of FIG. 10 after first passing through the lens of FIG. 6A and then passing through the optical cover of FIG. 8A. FIG. 16B is an iso-illuminance curve diagram of a light distribution produced by the light source of FIG. 10 after first passing through the lens of FIG. 6A and then passing through the optical cover of FIG. 9A.

Referring to FIG. 16A and FIG. 16B simultaneously, comparing FIG. 16A with FIG. 16B, the light distribution of FIG. 16A is narrower in the horizontal axis, and has a width being 4 times the pole height in the range of 0.1 fc, and the distribution of FIG. 16B is wider in the horizontal axis, and has a width being 5 times the pole height in the range of 0.1 fc. Therefore, FIG. 16B may have a wider spacing in the configuration of the spacing between the lamp poles.

Next, embodiments of different width to height ratios of the optical cover according to the above embodiments of the invention are described.

Figure 17:
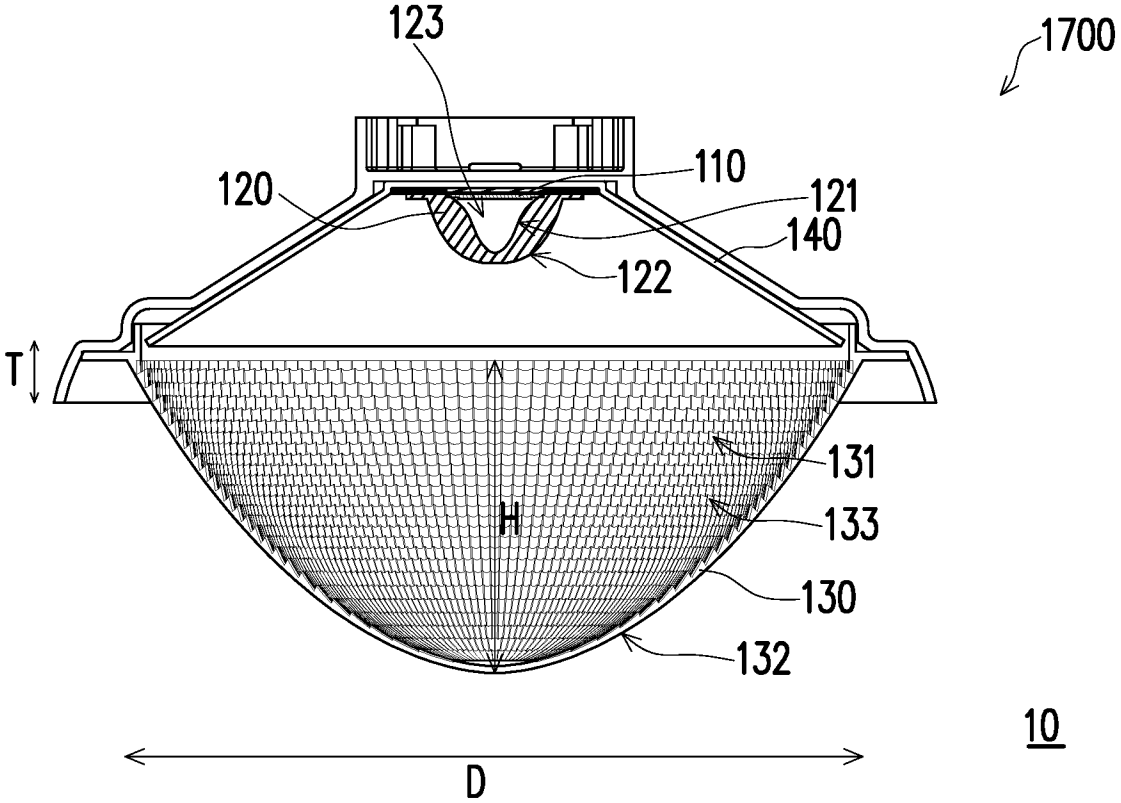
FIG. 17 shows a cross-section of the lighting device of the second embodiment of the invention.
Figure 18:
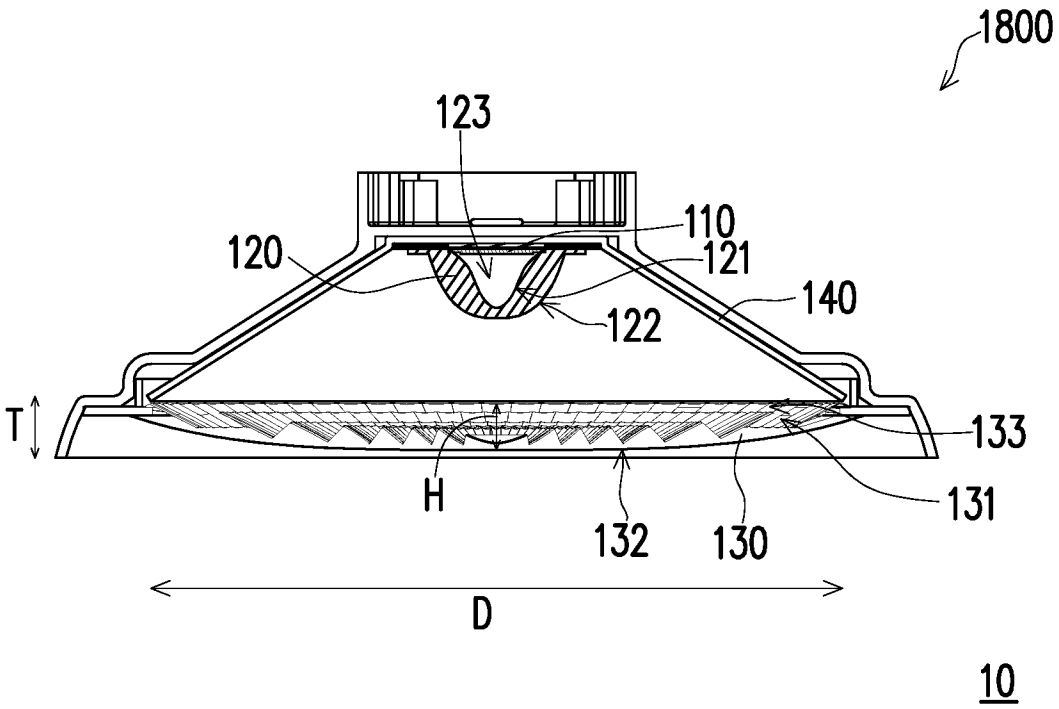
FIG. 18 shows a cross-section of the lighting device of the third embodiment of the invention.
Figure 19:
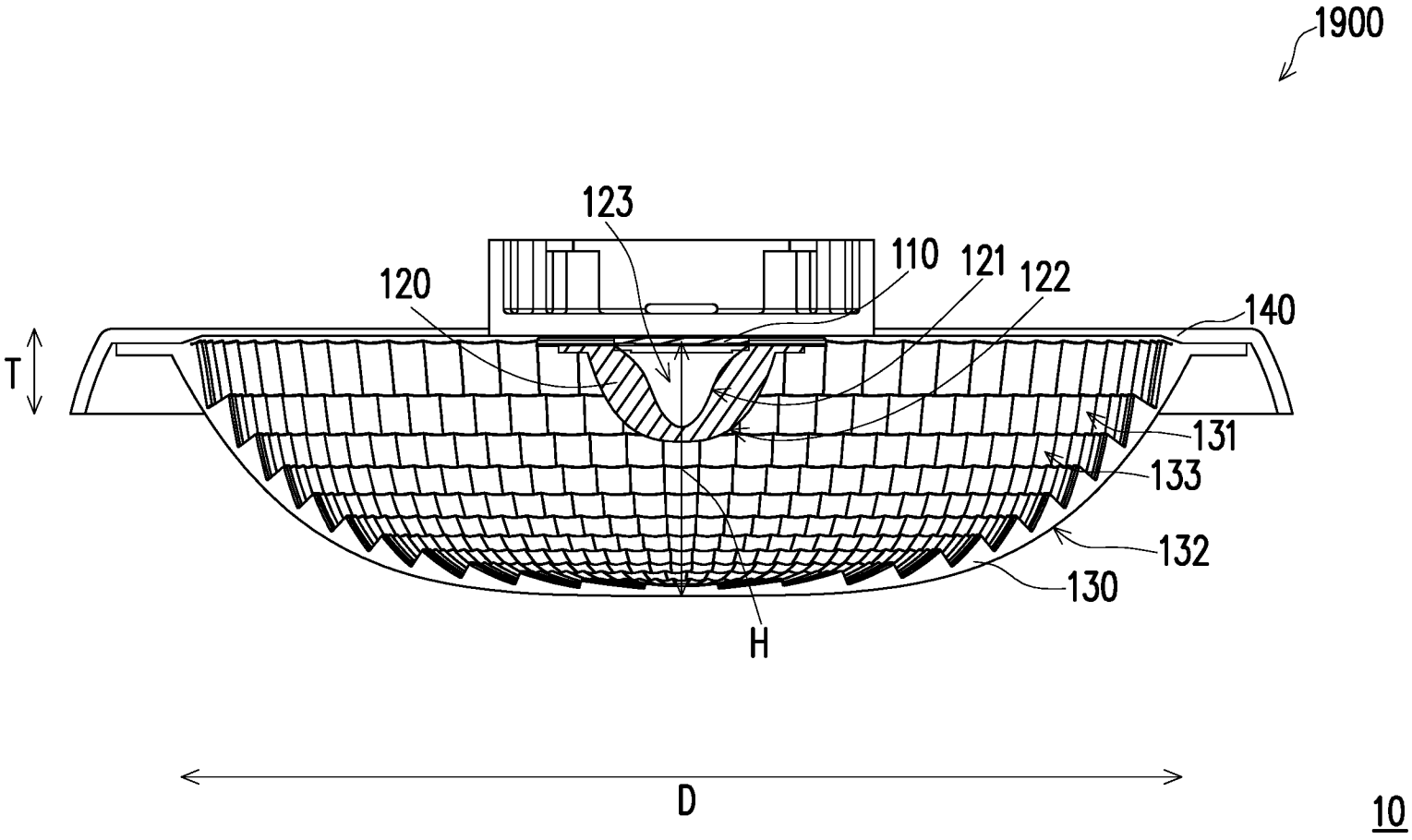
FIG. 19 shows a cross-section of the lighting device of the fourth embodiment of the invention.

FIG. 17 shows a cross-section of a lighting device of the second embodiment of the invention. FIG. 18 shows a cross-section of a lighting device of the third embodiment of the invention. FIG. 19 shows a cross-section of a lighting device of the fourth embodiment of the invention.

Referring to FIG. 1B first, in the present embodiment, the lighting device 10 further includes a reflection base 140, wherein the light source 110, the lens 120, and the optical cover 130 are all disposed on the reflection base 140. The reflection base 140 has a reflective surface 142 having a first angle $\alpha$ with respect to the central axis B of the light emitted by the light source 110, and a maximum intensity direction E of the light emitted by the light source 110 after passing through the lens 120 has a second angle $\beta$ with respect to the central axis B. For example, the light shape of FIG. 11A has a maximum intensity in a direction of ±60 degrees, the light shape of FIG. 11B has a maximum intensity in a direction of −30 degrees, and the light shape of FIG. 12A has a maximum intensity in a direction of ±45 degrees. Preferably, the second angle $\beta$ is less than or equal to the first angle $\alpha$, such that the lighting device 10 may light the maximum intensity direction E of the light shape on the desired location on the road according to the actual road condition, but the invention is not limited thereto.

Further, in the lighting device 10 of the present embodiment, the reflection base 140 has a flange 141, a thickness of the optical cover 130 in the direction parallel to the central axis B of the light emitted by the light source 110 is H, and a distance (i.e., the height of the flange 141) in the direction parallel to the central axis B from the bottom of the optical cover 130 adjacent to the light source 110 to the top of the flange 141 away from the light source 110 is T. In an embodiment of the invention (for example, the lighting device 10 of FIG. 18), $H \leq T$, and the optical cover 130 may be completely concealed within the flange 141 of the reflection base 140, thereby reducing the chance of being damaged by foreign objects from collision. In other embodiments of the invention (for example, the lighting device 10 of FIG. 1B and the lighting device 10 of FIG. 17), $H > T$, such that the optical cover 130 may be self-cleaned by, for example, rain or dew flowing thereover.

Furthermore, the outer diameter of the optical cover 130 in the direction perpendicular to the central axis B is D. It is worth mentioning that although the invention does not limit the size and ratio of the thickness H and the outer diameter D of the optical cover 140, in order to optimally implement the invention, D/H of the present embodiment is most preferably within the range of 0.5 to 25 when $H > T$. For example, D/H of the lighting device 10 of FIG. 1B may be 4.24, wherein the outer diameter D is 212 mm and the thickness H is 50 mm; D/H of the lighting device 10 of FIG. 17 may be 2.4, wherein the outer diameter D is 212 mm and the thickness H is 88 mm; and D/H of the lighting device 10 of FIG. 18 may be 21.2, wherein the outer diameter D is 212 mm and the thickness H is 10 mm.

Furthermore, the second light-emitting surface 132 of the optical cover 130 of the lighting device 10 in the above embodiments may be an integrated design, that is, the second light-emitting surface 132 of the optical cover 130 is a smooth curved surface, and the inside of the lighting device 10 may be sealed to achieve the function of dust-proof and waterproof, such that better environmental pollution resistance is achieved, that is, the maintenance cost is lower. In addition, the optical cover 130 may have refractive power when the thickness thereof is greater than about 1.5 mm, and therefore compared to the conventional lighting device that often requires a greater thickness to obtain sufficient refractive power, the optical cover 130 in the above embodiments may still have sufficient refractive power at a smaller thickness, and therefore the lighting device 10 in the above embodiments may also achieve reduced manufacturing cost.

In addition, in the present embodiment, the size of the flange height may be in accordance with design requirements, and the invention is not limited thereto, and an embodiment of the invention may include no flange, that is, T may be 0. Moreover, in the above embodiments, the first angle $\alpha$ of the reflective surface 142 of the reflection base 140 of FIG. 1B, FIG. 17, and FIG. 18 is less than 90 degrees, but the invention is not limited thereto. For example, as shown in FIG. 19, the first angle α of the reflective surface 142 of the reflection base 140 of the light distribution module 1900 may also be greater than or equal to 90 degrees.

The light distribution of the lighting device 10 of the embodiments of the invention may be divided into four types based on the lens 120, the optical cover 130, and the reflection base 140 of the lighting device (for example, the lighting device 10 of FIG. 1B, FIG. 17, and FIG. 18) of the embodiments of the invention. Specifically, referring to FIG. 1B, FIG. 17, and FIG. 18, the first type of light distribution is (for example, the lighting device 10 of FIG. 18): the ratio of the light energy of the light emitted by the light source 110 after passing through the optical cover 130 in the far-field light intensity distribution in the direction of 90 degrees or more with the optical axis A of the optical cover 130 to the total energy of the light after passing through the optical cover 130 is 0%, and the ratio of the light energy of the light after passing through the optical cover 130 in the direction of 80 degrees to 90 degrees with the optical axis A to the total energy is less than 10%.

In another embodiment, the second type of light distribution is: the ratio of the light energy of the light emitted by the light source 110 after passing through the optical cover 130 in the far-field light intensity distribution in the direction of 90 degrees or more with the optical axis A of the optical cover 130 to the total energy of the light after passing through the optical cover 130 is less than 2.5%, and the ratio of the light energy of the light after passing through the optical cover 130 in the direction of 80 degrees to 90 degrees with the optical axis A to the total energy is less than 10%.

In yet another embodiment, the third type of light distribution is: the ratio of the light energy of the light emitted by the light source 110 after passing through the optical cover 130 in the far-field light intensity distribution in the direction of 90 degrees or more with the optical axis A of the optical cover 130 to the total energy of the light after passing through the optical cover 130 is less than 5%, and the ratio of the light energy of the light after passing through the optical cover 130 in the direction of 80 degrees to 90 degrees with the optical axis A to the total energy is less than 20%.

Moreover, the fourth type of light distribution is (for example, the lighting device 10 of FIG. 1B and the lighting device 10 of FIG. 17): the ratio of the light energy of the light emitted by the light source 110 after passing through the optical cover 130 in the far-field light intensity distribution in the direction of 90 degrees or more with the optical axis A of the optical cover 130 to the total energy of the light after passing through the optical cover 130 is not limited, and the ratio of the light energy of the light after passing through the optical cover 130 in the direction of 80 degrees to 90 degrees with the optical axis A to the total energy is also not limited.

Based on the above, the light distribution module and the lighting device of the embodiments of the invention include a lens and an optical cover, and one of the lens and the optical cover produces a first light shape that is rotationally symmetric or non-rotationally symmetric, and the other of the lens and the optical cover produces a second light shape that is rotationally symmetric. Therefore, the light distribution module and the lighting device may produce the desired light shape through the combination of the lens and the optical cover, which may comply with the placement regulations of the lighting device and be adapted to various road conditions. In addition, the light distribution module and the lighting device of an embodiment of the invention may greatly reduce the number of designs of the optical cover by using a combination of the lens and the optical cover compared to a conventional lighting device.

Figure 20:
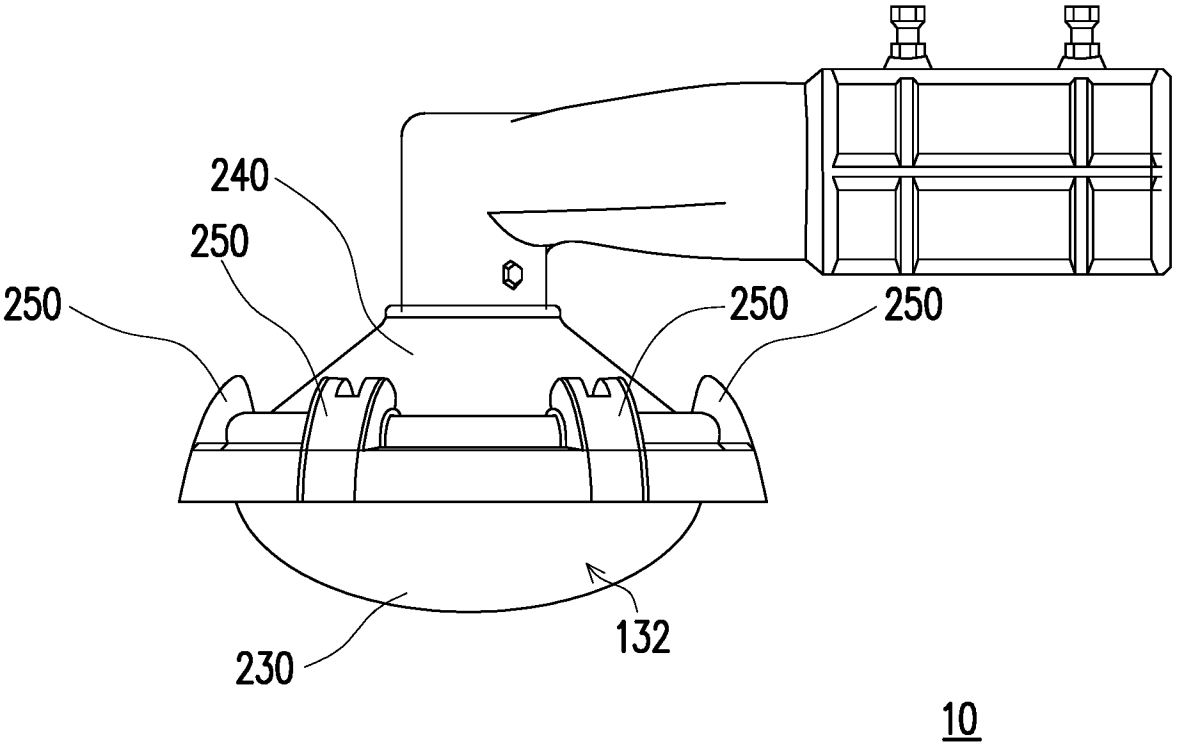
FIG. 20 shows a perspective view of an assembly structure of a lighting device of an embodiment of the invention.

FIG. 20 shows a perspective view of an assembly structure of a lighting device of an embodiment of the invention. Referring to FIG. 20, in the present embodiment, a reflection base 240 of the lighting device 10 of FIG. 20 may be the reflection base 140 of FIG. 1B. In addition, an optical cover 230 of the lighting device 10 of FIG. 20 may be the optical cover 130 of FIG. 1B. That is, the optical cover 230 of the lighting device 10 of FIG. 20 may be the optical cover 130A of FIG. 7A, the optical cover 130B of FIG. 8A, the optical cover 130C of FIG. 9A, or an optical cover used according to other requirements, and the invention is not limited thereto.

In addition, in the present embodiment, the lighting device 10 may be assembled on the reflection base 240 by means of, for example, a screw lock, a mechanical snap, an elastic platen, a hand-turning slot, or a combination thereof, but the invention is not limited to the above methods, and the optical cover 230 may also be assembled on the reflection base 240 by other suitable means, such as magnetic attraction, pasting, etc.

Based on the above, the light distribution module and the lighting device of an embodiment of the invention include a lens and an optical cover, and one of the lens and the optical cover produces a first light shape that is rotationally symmetric or non-rotationally symmetric, and the other of the lens and the optical cover produces a second light shape that is rotationally symmetric. Therefore, the light distribution module and the lighting device may produce the desired light shape through the combination of the lens and the optical cover, which may comply with the placement regulations of the lighting device and be adapted to various road conditions. In addition, the light distribution module and the lighting device of an embodiment of the invention may greatly reduce the number of designs of the optical cover by using a combination of the lens and the optical cover compared to a conventional lighting device.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A light distribution module configured to control a light distribution of a light source, the light distribution module comprising:

a lens having a first light-incident surface, a first light-emitting surface opposite to the first light-incident surface, and an accommodating recess located at a side of the first light-incident surface, wherein the accommodating recess is configured to contain the light source; and an optical cover covering the lens and having a second light-incident surface and a second light-emitting surface opposite to the second light-incident surface, wherein the second light-incident surface is located between the first light-emitting surface and the second light-emitting surface, the second light-incident surface has a plurality of sub-curved surfaces, and boundaries between adjacent sub-curved surfaces are bent-shaped with respect to the adjacent sub-curved surfaces, and the sub-curved surfaces are arranged into a multilayered annular shape around an optical axis of the optical cover, wherein the optical axis of the optical cover is substantially parallel to an optical axis of the light source, wherein the lens produces a first light shape that is rotationally symmetric, and the optical cover produces a second light shape that is non-rotationally symmetric, wherein a thickness from a geometric center of the sub-curved surface most distant from the optical axis of the optical cover to the second light-emitting surface in a normal direction of the geometric center of the sub-curved surface most distant from the optical axis is greater than a thickness from a geometric center of the sub-curved surface closest to the optical axis of the optical cover to the second light-emitting surface in a normal direction of the geometric center of the sub-curved surface closest to the optical axis.

2. The light distribution module of claim 1, wherein the lens has a longitudinal direction and a lateral direction, the first light-emitting surface has a cross-shaped protrusion, extending directions of an orthographic projection of the cross-shaped protrusion on a reference plane perpendicular to an optical axis of the lens are tilted with respect to the longitudinal direction and the lateral direction, the first light-incident surface has a cross-shaped depression, extending directions of an orthographic projection of the cross-shaped depression on the reference plane are tilted with respect to the longitudinal direction and the lateral direction, and the lens produces the first light shape that is rotationally symmetric.

3. The light distribution module of claim 1, wherein the lens has a longitudinal direction and a lateral direction, the first light-emitting surface has a cross-shaped protrusion, extending directions of an orthographic projection of the cross-shaped protrusion on a reference plane perpendicular to an optical axis of the lens are the same as the longitudinal direction and the lateral direction, the first light-incident surface has a cross-shaped depression, extending directions of an orthographic projection of the cross-shaped depression on the reference plane are the same as the longitudinal direction and the lateral direction, and the lens produces the first light shape that is rotationally symmetric.

4. The light distribution module of claim 1, wherein the first light-incident surface and the first light-emitting surface of the lens are both axisymmetric.

5. The light distribution module of claim 4, wherein a slope of the first light-incident surface gradually increases from a position most away from an optical axis of the lens to a position close to the optical axis of the lens.

6. The light distribution module of claim 1, wherein the optical cover has a longitudinal direction and a lateral direction, the optical cover is minor-symmetric in the longitudinal direction and is non-mirror-symmetric in the lateral direction, and the optical cover produces the first light shape that is non-rotationally symmetric.

7. The light distribution module of claim 6, wherein the sub-curved surfaces are arranged into a multilayered annular shape that are mirror-symmetric in the longitudinal direction and are non-mirror-symmetric in the lateral direction.

8. The light distribution module of claim 7, wherein a plurality of layers arranged in the multilayered annular shape near a center of the optical cover are heart-shaped rings.

9. The light distribution module of claim 1, further comprising a reflection base, wherein the light source, the lens, and the optical cover are all disposed on the reflection base.

10. The light distribution module of claim 9, wherein the reflection base has a reflective surface having a first angle with a central axis of a light emitted by the light source, a maximum intensity direction of the light emitted by the light source and having passed through the lens has a second angle with the central axis, and the second angle is less than or equal to the first angle.

11. The light distribution module of claim 9, wherein the reflection base has a flange, a thickness of the optical cover in a direction parallel to a central axis of a light emitted by the light source is H, a length of the flange in a direction parallel to the central axis is T, and $H \leq T$.

12. The light distribution module of claim 9, wherein the reflection base has a flange, a thickness of the optical cover in a direction parallel to a central axis of a light emitted by the light source is H, a length of the flange in a direction parallel to the central axis is T, and $H > T$.

13. The light distribution module of claim 1, wherein a thickness of the optical cover in a direction parallel to a central axis of a light emitted by the light source is H, an outer diameter of the optical cover in a direction perpendicular to the central axis is D, and D/H falls in a range of 0.5 to 25.

14. The light distribution module of claim 1, wherein boundaries of adjacent sub-curved surfaces arranged in a direction surrounding the optical axis of the optical cover have a ridge shape.

15. The light distribution module of claim 1, wherein boundaries of adjacent sub-curved surfaces arranged in a direction from an edge of the optical cover to a center of the optical cover has a step difference.

* * * * *